US009297217B2

(12) United States Patent
Paulsson

(10) Patent No.: US 9,297,217 B2
(45) Date of Patent: Mar. 29, 2016

(54) SENSOR POD HOUSING ASSEMBLY AND APPARATUS

(71) Applicant: Björn N. P. Paulsson, Woodland Hills, CA (US)

(72) Inventor: Björn N. P. Paulsson, Woodland Hills, CA (US)

( * ) Notice: Subject to any disclaimer, the term of this patent is extended or adjusted under 35 U.S.C. 154(b) by 322 days.

(21) Appl. No.: 13/986,735

(22) Filed: May 30, 2013

(65) Prior Publication Data

US 2014/0352422 A1 Dec. 4, 2014

(51) Int. Cl.

| | |
|---|---|
| ***E21B 47/00*** | (2012.01) |
| ***E21B 17/10*** | (2006.01) |
| ***E21B 47/01*** | (2012.01) |

(52) U.S. Cl.

CPC ..... *E21B 17/1021* (2013.01); *E21B 47/01* (2013.01)

(58) Field of Classification Search

None

See application file for complete search history.

(56) References Cited

U.S. PATENT DOCUMENTS

| | | | | |
|---|---|---|---|---|
| 2,742,606 | A | 4/1956 | Wann | |
| 2,899,633 | A | 8/1959 | Smith et al. | |
| 3,586,103 | A * | 6/1971 | Brown | E21B 43/017 166/339 |
| 3,661,205 | A | 5/1972 | Belorgey | |
| 3,795,141 | A | 3/1974 | Planche | |
| 4,480,186 | A | 10/1984 | Wolk | |
| 4,692,707 | A | 9/1987 | Locke et al. | |
| 5,092,423 | A | 3/1992 | Petermann | |
| 5,243,562 | A | 9/1993 | Laurent et al. | |
| 6,374,913 | B1 * | 4/2002 | Robbins et al. | 166/66 |
| 6,761,232 | B2 | 7/2004 | Moody et al. | |
| 7,436,185 | B2 | 10/2008 | Fredette et al. | |
| 7,748,476 | B2 | 7/2010 | Krueger | |
| 2006/0013065 | A1 * | 1/2006 | Varsamis | G01V 11/002 367/76 |
| 2008/0173454 | A1 * | 7/2008 | Smithson et al. | 166/324 |
| 2010/0078173 | A1 * | 4/2010 | Buytaert et al. | 166/302 |
| 2011/0031023 | A1 * | 2/2011 | Menezes et al. | 175/61 |
| 2011/0162836 | A1 * | 7/2011 | Church | 166/264 |
| 2013/0092441 | A1 * | 4/2013 | Hummes et al. | 175/56 |
| 2013/0118733 | A1 * | 5/2013 | Kumar | 166/254.2 |
| 2013/0192897 | A1 * | 8/2013 | MacKenzie et al. | 175/57 |
| 2013/0206397 | A1 * | 8/2013 | Georgi et al. | 166/250.01 |
| 2013/0213647 | A1 * | 8/2013 | Roddy et al. | 166/255.1 |
| 2014/0131033 | A1 * | 5/2014 | Galvan-Sanchez et al. | 166/250.01 |
| 2014/0151124 | A1 * | 6/2014 | Randall et al. | 175/52 |
| 2015/0060054 | A1 * | 3/2015 | Bordoloi et al. | 166/250.01 |
| 2015/0114714 | A1 * | 4/2015 | Dahl et al. | 175/40 |

* cited by examiner

*Primary Examiner* — Andre Allen

(74) *Attorney, Agent, or Firm* — John S. Reid

(57) ABSTRACT

A sensor pod housing assembly for placement within a borehole includes a housing, a selectively operable first hydraulic actuator supported by the housing and adapted to act in a first direction and a selectively operable second hydraulic actuator supported by the housing and adapted to act in a second direction which is substantially parallel to and opposite the first direction. The sensor pod housing assembly further includes a sensor pod adapted to contact a wall of the borehole when deployed to substantially immobilize the sensor pod relative to the borehole. A first substantially rigid link pivotally connects the first hydraulic actuator and the sensor pod, and a second substantially rigid link pivotally connects the second hydraulic actuator and the sensor pod.

19 Claims, 12 Drawing Sheets

SENSOR POD HOUSING ASSEMBLY AND APPARATUS

BACKGROUND

One or more methods of geological and geophysical exploration and/or research are conducted in connection with oil and gas recovery, as well as other fields of subterranean exploration, research and/or production (such as mineral mining, earthquake monitoring, and geothermal heat extraction). At least one method of such exploration and/or research involves forming a borehole (or well bore) within a subterranean formation, and thereafter placing one or more sondes or sensor pods within the borehole. The borehole can be either vertical or horizontal. Conventional sondes or sensor pods employed in this manner are often configured to detect and/or collect seismic and/or acoustic signals while disposed within the borehole. Accordingly, many conventional sondes or sensor pods are further configured to be selectively stabilized or immobilized within the borehole in order to facilitate detection and/or collection of seismic and/or acoustic signals. In this manner, the sondes or sensor pods are often selectively positioned and repositioned at various depths or locations within the borehole. Various types of prior art sondes or sensor pods have been developed for detecting and/or collecting seismic, acoustic and/or other types of data within a borehole or well hole. Further, various types of prior art devices have been developed with the goal of selectively stabilizing or immobilizing such sondes or sensor pods within the borehole. However, certain shortfalls can be associated with such prior art sondes and/or sensor pods, and devices for stabilizing the same within boreholes.

More specifically, it is desirable to form a firm and secure connection between the sensing units (contained within the sondes and/or sensor pods) and the wall of the borehole so that positive mechanical and acoustical coupling occurs. Such positive mechanical and acoustical coupling of the sensor support units (i.e., the sondes and/or sensor pods) with the borehole wall improves the quality of the signal received by the sensing unit, and also reduces the opportunity for miscellaneous noise to be introduced (which can result from movement between the borehole wall and the sonde and/or sensor pod). Thus, the clamping force exerted between the borehole wall, and each sonde and/or sensor pod in an array of such devices, is significant in contributing to the overall quality of data collected by the array.

Further, it is not only desirable that each sonde and/or sensor pod within a receiver array be able to establish a firm and secure connection to the borehole wall during a data collection period, but it is also desirable that each sonde and/or sensor pod within a receiver array be able to affirmatively decouple from the borehole wall so that the receiver array may be easily repositioned within, or withdrawn from, the borehole. Many prior art devices provide for forming a secure physical (and thus, acoustical) connection between a sonde and/or sensor pod and a borehole wall. However, these devices do not allow for the sonde and/or sensor pod to be affirmatively withdrawn (or retracted) from contact with the borehole wall following data collection. This is particularly problematic when the sondes/pods are to be repositioned within, or withdrawn from, the borehole. Specifically, it is desirable that: (i) individual sondes/pods do not become stuck against the borehole wall when the receiver array is to be (a) further lowered within the borehole after an initial set of readings are taken from the sensors in the receiver array, or (b) withdrawn from the borehole following data recording; and (ii) individual sondes/pods do not abrade against the borehole wall when the receiver array is being withdrawn from the borehole. In the latter situation (i.e., sondes/pods abrading against the borehole wall while the receiver array is being withdrawn from the borehole), such abrasion can produce the following deleterious effects. In the first instance, if the outer wall of the sonde/pod is roughened by such abrasion, then the mechanical and acoustical coupling between the outer wall of the sonde/pod and the borehole wall will likely be reduced, thus resulting in lower quality of data received by the sensors within the well sonde/pod. In the second instance, if the thickness of the outer wall of the sonde/pod is reduced by such abrasion, then the initial calibration of the data quality and vector fidelity recorded by the sensor will change thus affecting the quality of the measurements taken by the sensors in the sonde/pod.

As can be appreciated, the problems described above are significant even for a single sonde/sensor placed within a borehole, but become more acute then encountered within a receiver array comprising a plurality of sondes and/or sensor pods.

It is thus desirable to provide for an array of sondes/pods, which are to be deployed in a downhole subterranean formation, which: (i) allows for a positive mechanical and acoustical connection of each sonde/pod in the array with the borehole wall formed in the subterranean formation; and (ii) also allows for each sonde/pod in the array to be affirmatively withdrawn from contact with the borehole wall (as selectively desired) so that the array of sondes/pods can be moved within the borehole (i.e., relocated within, or withdrawn from, the borehole) without the borehole wall degrading the physically integrity of the sondes/pods, and consequently affecting (i.e., degrading) the quality of signals received by sensors within the sondes/pods. It is further desirable to provide for a mechanism which not only achieves the desired positive mechanical and acoustical connection of each sonde/pod in the array with the borehole wall, but further (and subsequently) achieves the removal (in a positive manner) of each sonde/pod in the array from contact with the borehole wall. It is furthermore desirable that the borehole seismic array can be deployed without the use of expensive borehole tractors in both vertical and horizontal boreholes.

DETAILED DESCRIPTION

Figure 1:
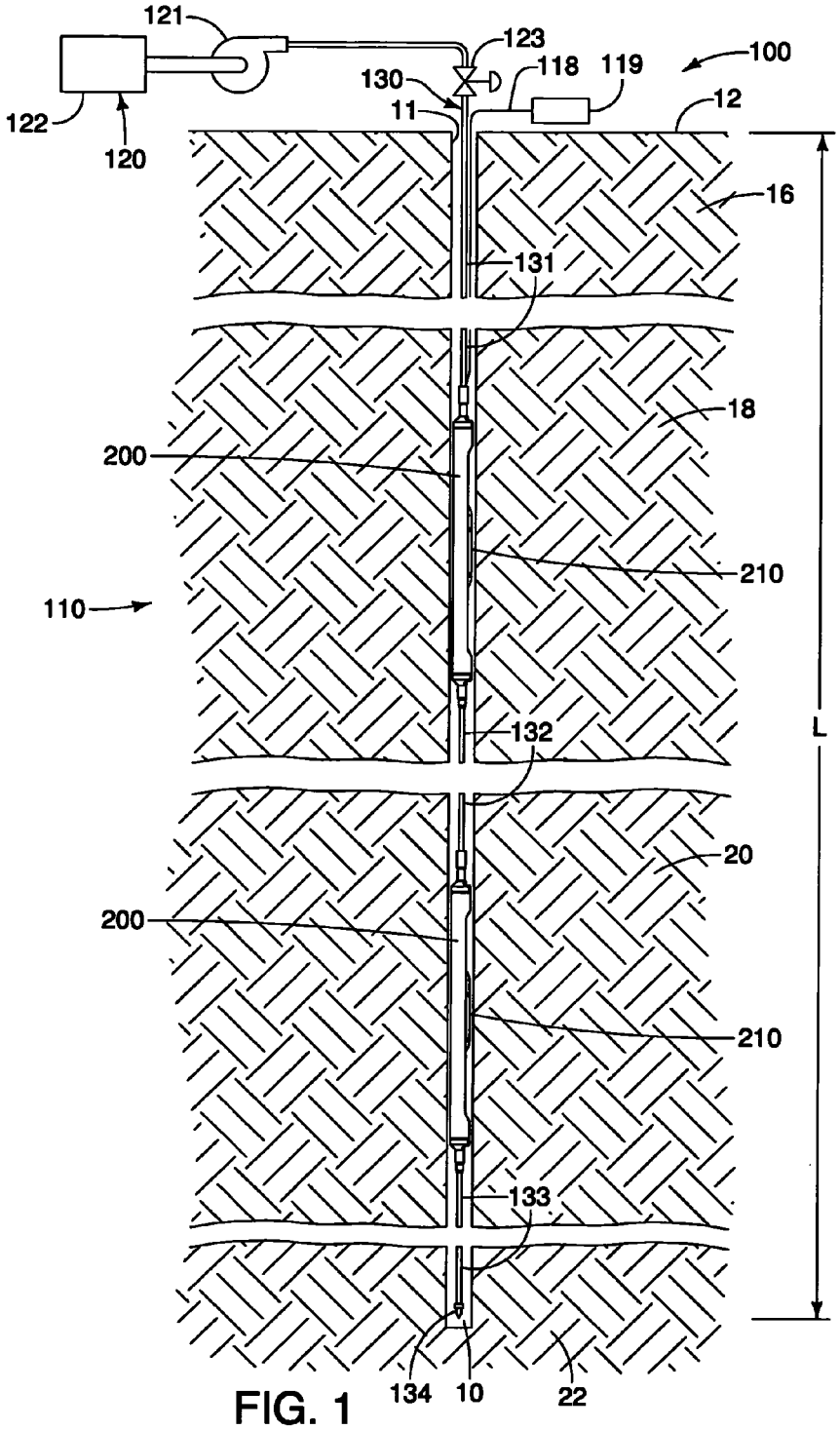
FIG. 1 is a side elevation view of an apparatus according to one embodiment of the disclosure, depicting the apparatus in use.

With reference to the accompanying drawings, FIG. 1 is a side elevation view in which an apparatus 100 is depicted according to at least one embodiment of the disclosure. The apparatus 100 includes a string or array 110. The apparatus 100 also includes a hydraulic power source 120. The hydraulic power source 120 can include, for example, a hydraulic pump 121 and an engine or motor 122 that is coupled to the pump. The motor 122 is configured to provide mechanical power to the drive the pump 121. The pump 121 is configured to pressurize a hydraulic fluid (not shown). The power source 120 can also include a control device 123. The control device 123 is configured to selectively control one or more characteristics of pressurized hydraulic fluid that is provided by the pump 121. For example, the control device 123 can be configured to selectively control pressure and/or flow rate of hydraulic fluid provided by the pump 121. According to at least one embodiment of the disclosure, the control device 123 can include or be substantially in the form of a valve or a pressure regulator.

The string or array 110 includes one or more sensor pod housing assemblies 200. Each sensor pod housing assembly 200 comprises a housing or shell (described more fully below), a sensor pod (or sonde) 210, and a clamping actuator assembly (which may also be referred to herein as a clamping device, clamping assembly, or sensor pod deployment device), all of which will be described more fully below. The string 110 also includes a line 130. The line 130 can be separated into one or more sections. According to the exemplary embodiment of the disclosure, the string 110 includes a first section of line 131, a second section of line 132, and a third section of line 133. It is to be understood, however, that the string can include as many sensor pod housing assemblies 200 and/or line sections as is required to perform a specific task as intended. In another arrangement the line 130 can be a continuous line, with tee sections (or "T"-sections) at each of the sensor pod housing assemblies 200. The line 130 can also include a terminus portion 134, which can be in the form of an end cap, for example. The line 130 is connected to the pump 121 and one or more sensor pod housing assemblies 200. The line 130 is configured to convey or conduct hydraulic fluid between the pump 121 and the one or more sensor pod housing assemblies 200. The line 130 can also be adapted to convey or conduct signals such as data signals to or from one or more of the sensor pod housing assemblies 200. Alternately, a separate signal line (not shown in FIG. 1) can be provided with the array 110 to convey or conduct signals such as data signals to or from one or more of the sensor pod housing assemblies 200. In one example the line 130 can be coiled tubing which can be stored on a reel, along with the sensor pod housing assemblies 200, for later deployment into a wellbore, as discussed below. In another example the line 130 can be drill pipe. In one variation the line 130 is modified drill pipe specifically modified to support the weight of the array 110 when deployed in a vertical or horizontal borehole 10 (as will be described more particularly below).

The line 130 is configured to support all of the components thereof, including the one or more sensor pod housing assemblies 200, while the line and its various components are suspended within a borehole, wellbore, or well hole 10 that is bored through ground surface 12. The borehole 10 is defined by a borehole wall 11. The borehole 10 descends beneath ground surface 12 through an upper region 16, and then through an intermediate region 18, and then through a lower region 20 before terminating in a bottom region 22. Regions 18, 20 and 22, collectively, can define a subterranean formation which contains, or may potentially contain, oil and/or gas deposits which are desirable for extraction therefrom, or from which geothermal energy can be recovered. The borehole 10 can be substantially vertical as shown or horizontal (not shown). However, it is to be understood that the apparatus 100 and/or various portions thereof can also be deployed in boreholes that are not substantially vertical—i.e. deviated from the vertical direction up to true horizontal. While in FIG. 1 the apparatus 100 is depicted as occupying a substantial portion of the bore 10, it is understood that this is not a requirement, and that the apparatus 100 can occupy only a fraction of the borehole along its length.

According to the exemplary embodiment of the disclosure, the first section 131 of the line 130 is coupled between the pump 121 and one of the sensor pod housing assemblies 200. The second section 132 of the line 130 is coupled between two of the sensor pod housing assemblies 200. The third section 133 of the line 130 is located between one of the sensor pod housing assemblies 200 and the terminus 134. The first section 131 is adapted to convey hydraulic fluid (not shown) between the pump 121 and a first one of the sensor pod housing assemblies 200. The second section 132 is adapted to convey hydraulic fluid between the pump 121 and two of the sensor pod housing assemblies 200 as shown. More specifically, the sensor pod housing assemblies 200 can be hydraulically connected in series to the pump 121 by way of respective sections 131, 132 of the line 130. The hydraulic fluid can be, for example, the fluids commonly found in the wellbore, or a special fluid (such as a low viscosity oil) provided to the wellbore. Each of the line sections 131, 132, 133 can be one of a number of possible lengths as required or desired. For example, each of the line sections 131, 132, 133 can be of a respective predetermined length suitable to facilitate performance of a specific task for which the apparatus 100 is intended. In one example the line sections are custom line fabricated from a steel alloy commonly used for drill pipe material, such as S135 steel. The pipe sections can be 19 feet in length, with a nominal outside diameter of 1.660 inches, and a nominal inside diameter of 1.180 inches. The ends of the pipe sections 131, 132, 133 are threaded in respective opposing male and female connectors. Preferably, the threads on the pipe section threaded connectors have a thread pitch which is lower than the thread pitch used for drill pipe. That is, threaded connections for drill pipe are provided with threads that have a relative high thread pitch in order to resist torque forces applied to the drill pipe (and thus, the threaded drill pipe screwed connections) generally encountered during a drilling operation. However, for the pipe 130 used in the apparatus 100 (FIG. 1), the primary concern is not resisting torque, but rather in resisting static axial load applied along the length of the pipe 130 (and apparatus 100). That is, a lower thread pitch (i.e., lower than the thread pitch used for a drilling application) applied to the threads on the pipe 130 provides greater static support for the apparatus.

With further reference to FIG. 1, the sensor pods 210 can all be placed in signal communication with a data collection processor 119 via signal line (or lines) 118 placed along pipe sections 131, 132 and 133 and inside sensor pod housing assemblies 200. The data collection processor 119 can be, by way of example, a data recorder configured to receive and store signals from the various sensor pods 210. The signal line (or lines) 118 can be one or more wires or optical fibers for communicating signals received by the sensor pods 210 (and more specifically, by sensors embedded within the sensor pods 210) to the data collection processor 119. Further, the data collection processor 119 can be configured to receive and parse multiplexed signal information communicated along the one or more signal lines 118 using known means for receiving and parsing time-based signals received along a common signal line.

It is to be understood that the apparatus 100 of FIG. 1 can include additional components not specifically depicted and/or discussed herein. For example, the apparatus 100 can include a string deployment device (not shown) that can include a derrick or crane and a reel or the like for lowering and retrieving the string 130 into and out of the borehole 10.

Figure 2:
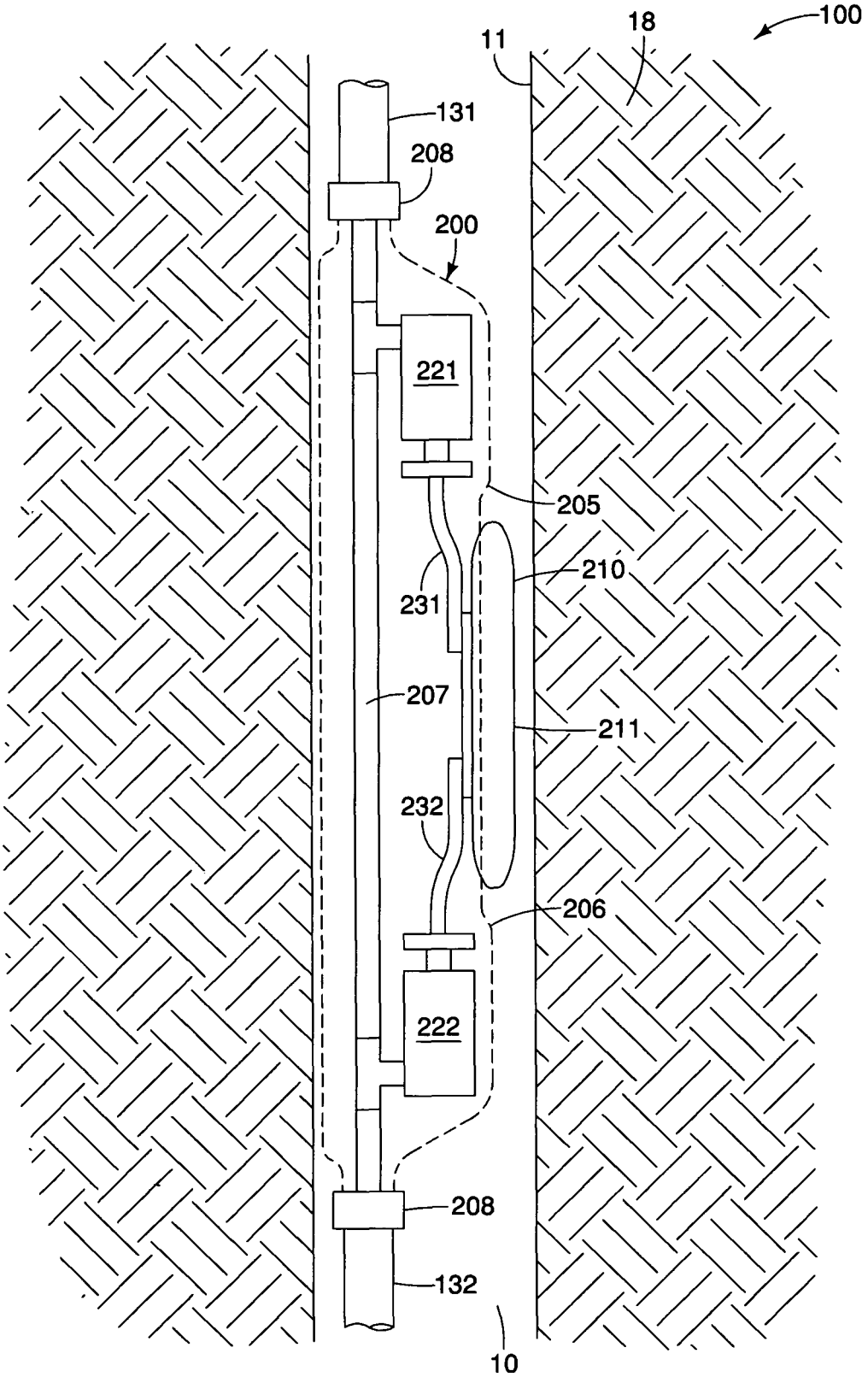
FIG. 2 is a side elevation view of a sensor pod housing assembly according to one embodiment of the disclosure.

With continued reference to the accompanying drawings, FIG. 2 is a detail side view of a sensor pod housing assembly 200 of FIG. 1. The assembly 200 depicted in FIG. 2 is located within the intermediate region 18 of the borehole 10 as is also shown in FIG. 1. With reference to FIG. 2, the sensor pod housing assembly 200 includes a housing or outer shell or enclosure 205, which is depicted in phantom line for illustrative purposes. The housing 205 can be adapted to provide substantial protection of one or more internal components of the sensor pod housing assembly 200, which internal components are described herein with respect to additional drawing figures. The enclosure 205 can be configured to be substantially rigid. More specifically, the enclosure 205 can be configured substantially in the manner of a structural component. For example, the enclosure 205 can be formed or fabricated from a structural material. For example, the enclosure 205 can be formed or fabricated from a material such as steel, aluminum alloy, or one of a number of synthetic materials such as fiberglass or carbon fiber and the like. According to at least one embodiment of the disclosure, the enclosure 205 is fabricated at least in part from wellbore lining piping using steel known as J55, N80 or P110 and acts as a chassis or frame to which other components of the sensor pod housing assembly 200 are mounted or attached, or from which one or more components are supported.

Still referring to FIG. 2, the sensor pod housing assembly 200 includes a deployable element or sensor pod 210, which includes the sensors. The deployable element 210 is adapted to be selectively deployed from the sensor pod housing 205 through an opening (206) in the housing 205. The deployable element 210 has a first side 211, or front side, that is adapted to contact the wall 11 of the borehole 10 as a result of deployment of the deployable element 210 from the pod 200. In this manner, deployment of the deployable element 210 from the pod assembly 200 is intended to facilitate substantial stabilization or immobilization of the pod relative to the borehole 10, that is, clamping of the sensor pod 210 to the borehole wall. Such stabilization and/or immobilization of the sensor pod 210 relative to the borehole 10 can be advantageous, for example, when the sensor pod is being employed to detect seismic and/or acoustic signals. FIG. 2 reveals that the enclosure or housing 205 defines an opening 206. The opening 206 is sized and/or otherwise configured to allow the deployable element 210 to substantially pass through the opening during deployment of the element. According to at least one embodiment of the disclosure, the opening 206 is sized and/or otherwise configured to allow the deployable element 210 to be substantially nested within the opening when the element is not deployed. For example, FIG. 2 depicts the deployable element 210 as being only partially nested within the opening 206 of the enclosure 205, it being understood that the element 210 can be further retracted left-ward (with respect to FIG. 2) into housing (or enclosure) 205 such that the first side 211 of the element 210 does not protrude beyond the right-most side of the enclosure 205.

While not specifically depicted in the drawings, it will be appreciated that in a plan view a cross section of the enclosure 205 can be generally ovoid or circular to facilitate passage thereof through a circular wellbore 10. Further, the first side 211 of the element 210 can be provided with sensors and the like (not shown) intended to contact the wall 11 of the borehole 10 when the deployable element 210 is in a deployed position, as discussed and described further below. The sensors within deployable element 210 (which sensors are intended to placed into sensing contact with wall 11 of borehole 10 when the element is in the deployed position) can comprise any number of sensors configured to sense and/or detect a condition from the borehole wall 11. For example, sensors within sensor pod (i.e., the deployable element) 210 can comprise (without by way of limitation): one or more electric geophones or fiber optic seismic sensors configured to receive elastic wave or acoustic wave information from the borehole wall; an electrical resistivity sensor; an electrical conductivity sensor; an electrical capacitance sensor; a moisture detection sensor; a temperature sensor; and/or a pressure sensor.

With further reference to FIG. 2, the sensor pod housing assembly 200 includes a manifold 207. The manifold 207 is configured to contain and convey hydraulic fluid. According to the exemplary embodiment of the disclosure, the manifold 207 is adapted to convey hydraulic fluid between the first line section 131 and the second line section 132. As is shown the manifold 207 can be located within the enclosure 205. According to at least one embodiment of the disclosure, the manifold 207 is configured to be substantially rigid as in the manner of a structural component. For example, according to at least one embodiment of the disclosure, the manifold 207 is adapted to act as a chassis or frame to which one or more components of the pod assembly 200 are mounted or from which one or more components are supported. The manifold 207 can be in fluid communication with one or more hydraulic fluid sources, such as line sections 131, 132, by way of one or more connections 208. The connections 208 can include and/or can be substantially in the form of couplings or the like. The connections 208 can be adapted to allow the pod assemblies 200 to be selectively connected to (and/or disconnected from) one or more line sections, such as line sections 131, 132 as illustratively depicted in FIG. 2. Several types of hydraulic connections and/or couplings are known to those skilled in the art.

With continued reference to FIG. 2, the sensor pod housing assembly 200 includes a first actuator 221 and a second actuator 222. The first actuator 221 and the second actuator 222 each have the form of hydraulic actuators according to at least one embodiment of the disclosure. According to the exemplary embodiment of the disclosure, the first actuator 221 and the second actuator 222 are each linear hydraulic actuators. The first actuator 221 and the second actuator 222 can be operatively connected to the manifold 207, such as by the tee (or "T") connections (shown but not numbered). In this manner, the first actuator 221 and the second actuator 222 can be in fluid communication with the manifold 207. According to the exemplary embodiment of the disclosure, the first actuator 221 and the second actuator 222 are fluidly and operatively connected to the manifold 207 in an essentially parallel arrangement, as shown in FIG. 2. The actuators 221, 222 are structurally supported by a chassis such as the manifold 207, for example, if the manifold is adapted to act as a structural component such as a chassis or frame. Alternatively, or in addition, the actuators 221, 222 can be structurally supported by other components such as the enclosure 205, for example, if the enclosure is adapted to act as a structural component such as a chassis or frame. (FIGS. 8A and 8B, below, provide one example where the actuators are supported by the sensor pod housing.) According to the exemplary embodiment of the disclosure shown in FIG. 2, the actuators 221, 222 are supported by the manifold 207.

Still referring to FIG. 2, the sensor pod housing assembly 200 includes a first member 231 and a second member 232. The first member 231 is connected between the first actuator 221 and the deployable element 210. The second member 232 is connected between the second actuator 222 and the deployable element 210. In accordance with at least one embodiment of the disclosure, the first member 231 and the second member 232 are each deformable members that are adapted to deform or deflect when subjected to a predetermined range of force. According to the exemplary embodiment of the disclosure depicted in FIG. 2, the first member 231 and the second member 232 are each configured to resiliently deflect or deform such as, for example, in the manner of a spring. More specifically, the first member 231 and the second member 232 are each substantially in the form of resiliently deformable bow springs (or, more particularly, half-bow springs) according to the exemplary embodiment of the disclosure depicted in FIG. 2. The first member 231 can be substantially rigidly connected to the first actuator 221, and can also be substantially rigidly connected to the deployable element 210. Similarly, the second member 232 can be substantially rigidly connected to the second actuator 222, and also substantially rigidly connected to the deployable element 210. According to the exemplary embodiment of the disclosure, the first and second members 231, 232 are rigidly connected to the deployable element 210 and are rigidly connected to the first and second actuators 221, 222, respectively. In one variation, the first and second members 231, 232 can be non-rigidly connected to the deployable element 210 such as by a pin or the like which allows the deployable element 210 to pivot slightly about the members 231, 232. In another variation the first and second members 231, 232 can be non-rigidly connected to the respective first and second actuators 221, 222.

I have discovered that providing two actuators (221, 222) provides at least two advantages over prior art devices. Specifically, this arrangement improves the coupling or clamping force exerted between the deployable element 210 and the borehole wall 11, and also provides for a more even application of this coupling force over the length of the deployable element 210. Second, this arrangement facilitates positive withdrawal the deployable element 210 from contact with the borehole wall (11, FIG. 1) to facilitate free movement of the apparatus 100 within the borehole 10. While this arrangement does increase parts count over prior art devices (and thus cost and mechanical complexity), the enhanced coupling of the sensors to the borehole wall (as compared to prior art devices) which can be achieved using the two-actuator configuration outweigh the disadvantages.

Figure 3:
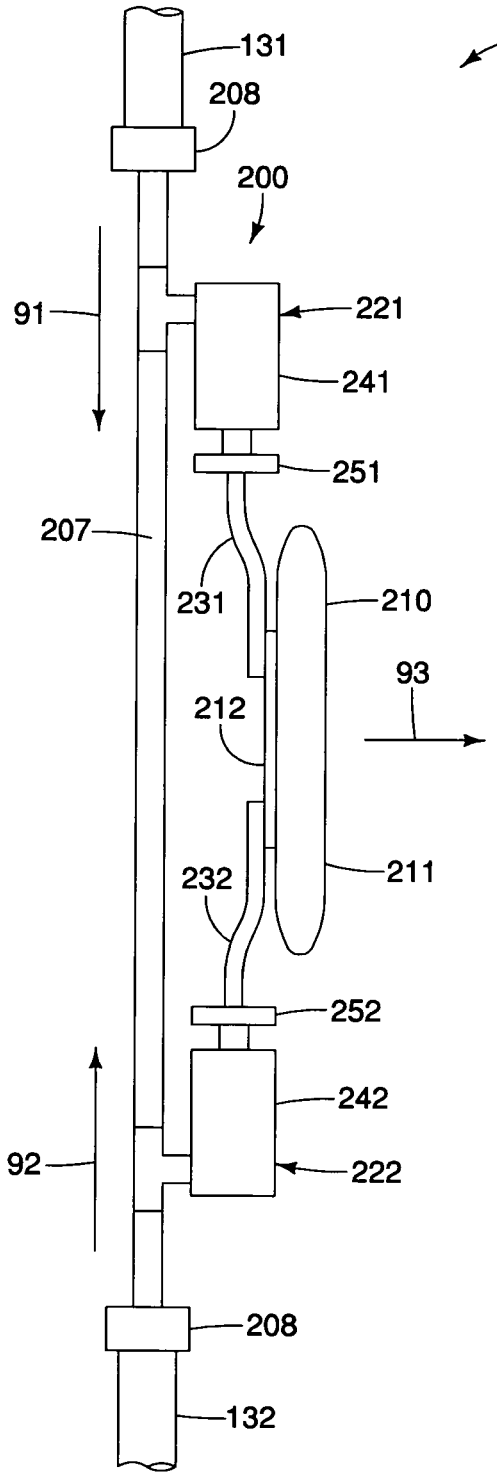
FIG. 3 is a side elevation view of selected components of the sensor pod housing assembly depicted in FIG. 2.

Turning now to FIG. 3, a side elevation view depicts the pod assembly 200, which is shown in FIG. 2, except that the housing enclosure (205, shown in FIG. 2) has been omitted from FIG. 3 for illustrative purposes. As is seen from a study of FIG. 3, the first actuator 221 includes a stationary portion 241 and a movable portion 251. Similarly, the second actuator 222 includes a stationary portion 242 and a movable portion 252. The stationary portions 241, 242 remain substantially stationary relative to a portion of the pod 200 on which the stationary portions are mounted or supported, such as the manifold 207, according to the exemplary embodiment of the disclosure. The first movable portion 251 is adapted to move relative to the first stationary portion 241 when the first actuator 221 is operated or activated. Likewise, the second movable portion 252 is adapted to move relative to the second stationary portion 242 when the second actuator 222 is operated or activated. According to the exemplary embodiment of the disclosure, the first member 231 is connected to the first movable portion 251, and the second member 232 is connected to the second movable portion 252. The first member 231 and the second member 232 are also both connected to the deployable element 210 according to the exemplary embodiment of the disclosure. More specifically, the first member 231 and the second member 232 can be connected to the second side or rear side 212 of the deployable element 210. The second side or rear side 212 is opposite the first side, or front side 211 of the deployable element 210. The actuators 221, 222 are preferably hydraulic actuators, but other forms of actuators (such as solenoids and pneumatic actuators) can be used.

With continued reference to FIG. 3, the first actuator 221 is configured to act or move in a first direction 91. More specifically, the first movable portion 251 is configured to move in the first direction 91 when the first actuator is activated or operated. The second actuator 222 is configured to act or move in a second direction 92. More specifically, the second movable portion 252 is configured to move in the second direction 92 when the second actuator is activated or operated. According to the exemplary embodiment of the disclosure, the first and second actuators 221, 222 are linear actuators that are configured to act or extend linearly as is indicated by the linear nature of both the first direction 91 and the second direction 92. Each of the first and the second actuators 221, 222 can be operated or activated in response to receiving hydraulic fluid from the manifold 207. According to the exemplary embodiment of the disclosure, each of the first and the second actuators 221, 222 receives substantially equal flow rates and/or pressures of hydraulic fluid from the manifold 207. In accordance with at least one embodiment of the disclosure, the first actuator 221 is substantially identical to the second actuator 222, at least inasmuch as both actuators can have substantially identical strokes and can produce substantially identical forces from a common hydraulic pressure supply.

Still referring to FIG. 3, the first direction 91 and the second direction 92 can be substantially parallel, as shown. The first direction 91 can be substantially opposite the second direction 92. The first direction 91 and the second direction 92 can be substantially collinear. According to the exemplary embodiment of the disclosure as depicted in FIG. 3, the first direction 91 and the second direction 92 can be collinear and opposite. Further, the linear directions 91, 92 of movement of the moveable portions 251, 252 of respective actuators 221, 222 are substantially parallel to the housing 205 (FIG. 2), the manifold 207, and in general the wellbore 10. This arrangement (of placing the actuators 221, 222 in substantially linear orientation with the sensor pod 210) allows for a more streamlined (i.e., smaller diameter) configuration for the sensor pod housing assembly 200 over prior art devices wherein an actuator is disposed in between the sensor pod 210 and the opposite interior wall of the housing. According to the exemplary embodiment of the disclosure, an activation of both the first actuator 221 and the second actuator 222 will cause deployment or movement of the deployable element 210 in a third direction 93. The third direction 93 can be substantially normal to both the first direction 91 and to the second direction 92, as shown in FIG. 3. The third direction 93 can be substantially normal to the first side or front side 211 of the deployable element 210.

Figure 4:
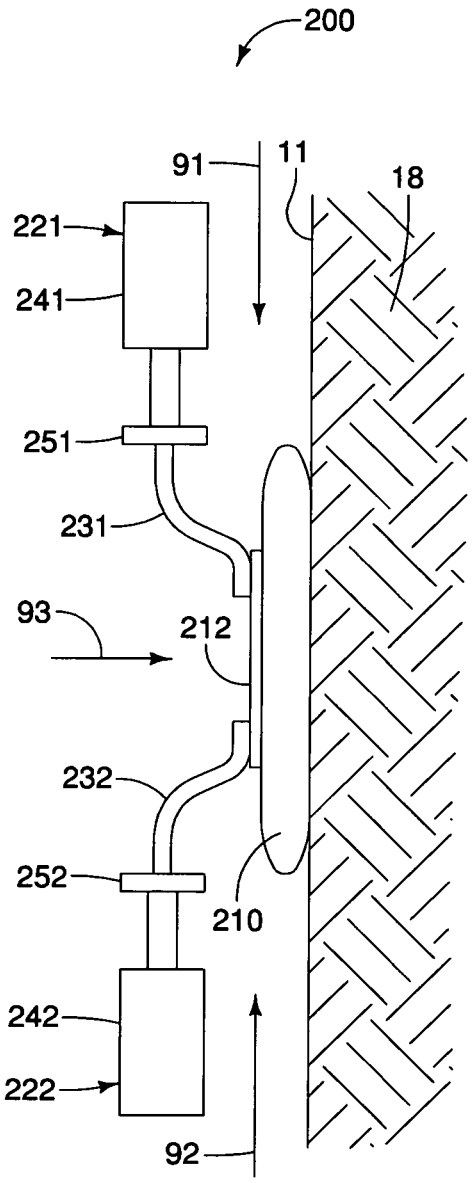
FIG. 4 is another side elevation view of the sensor pod housing assembly components depicted in FIG. 2, but showing the sensor pod in a deployed state.

Turning now to FIG. 4, another side elevation view depicts a portion of the pod assembly 200 shown in FIGS. 2 and 3. (Housing 205 of FIG. 2 is not shown in FIG. 4 in order to facilitate depiction of the relevant shown components.) With reference to both FIGS. 3 and 4, it is seen that FIG. 4 depicts the first and second actuators 221, 222 in respective activated states, and depicts the deployable element 210 in a deployed state. That is, FIG. 4 shows that the first movable portion 251 and the second movable portion 252 have extended (from the positions depicted in FIG. 3) respectively in the first direction 91 and in the second direction 92, and that the deployable element 210 has moved or deployed in the third direction 93 to contact the wall 11 of the borehole 10. A study of FIG. 4 reveals that the first deformable member 231 and the second deformable member 232 have deflected or bent as a result of activation of the first actuator 221 and the second actuator 222. More specifically, the first and second elements 231, 0.232 have deflected as a result of movement of the first and second actuator portions 251, 252 substantially toward each other in the first and second directions 91, 92, respectively. In turn, deflection of the first and second deformable members 231, 232 have caused the deployable element 210 to move in the third direction 93 relative to the first and second actuators 221, 222. According to the exemplary embodiment of the disclosure, the deformable members 231, 232 are resiliently deformable inasmuch as the members will tend to return to their respective non-deformed shape once the force exerted by respective actuator portions 251, 252 is removed from the deformable members 231, 232. Such resilient deformation is typical for various types of resilient members such as springs and the like known to those skilled in the art. In this manner, deactivation of the first and second actuators 221, 222 can allow the resilient nature of the members 231, 232 to return the actuators to their respective deactivated positions, which are depicted in FIG. 3. Such resilient nature of the members 231, 232 can also allow substantial return of the deployable member 210 to its non-deployed position (as depicted in FIGS. 2 and 3) upon deactivation of the actuators 221, 222. In this way the member 210 can be retracted from contact with the borehole wall 11 merely by lowering the hydraulic pressure within the manifold 207 and the fluid line 130 (FIG. 1). This provides for passive fail-safe operation of the apparatus 100, such that the apparatus does not rely on an actuator for positive disengagement of the member 210 from the borehole wall.

Figure 5:
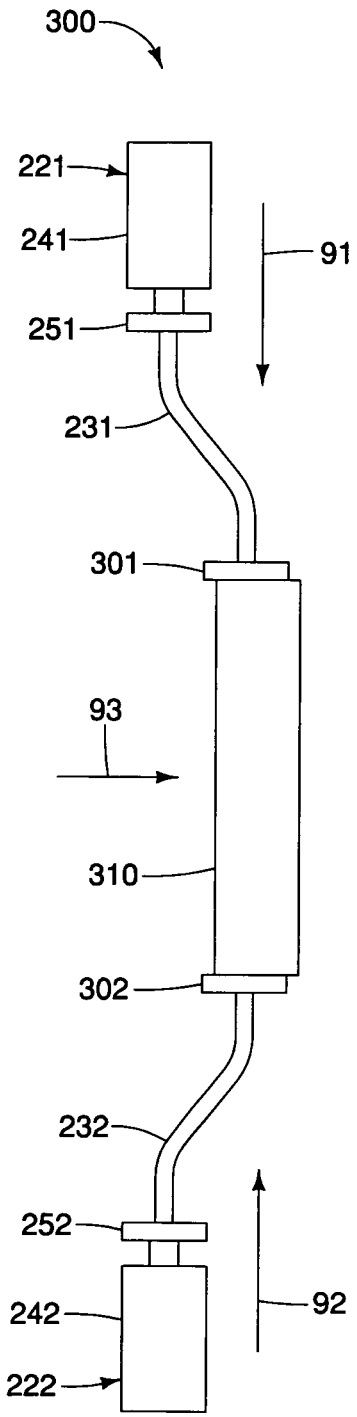
FIG. 5 is a side elevation view of an alternative embodiment of selected components of a sensor pod housing assembly according to the disclosure.

Turning now to FIG. 5, another side elevation view depicts at least a portion of a sensor pod housing assembly 300, which is an alternative configuration of the sensor pod housing assembly 200 (depicted in FIGS. 2-4). The sensor pod housing assembly 300 can be configured substantially similarly to, and can include substantially the same components as, the sensor pod housing assembly 200, except as specifically described with respect to FIG. 5. Accordingly, some common components of the pod assemblies 200 and 300 are not shown in FIG. 5 (as for example, the housing 205 of pod assembly 200). The sensor pod housing assembly 300 depicted in FIG. 5 includes first and second actuators 221, 222 which can be identical to the actuators of the sensor pod housing assembly 200. Additionally, the first and second deformable members 231, 232 of the sensor pod housing assembly 300 can be substantially identical to the deformable members of the sensor pod housing assembly 200. With continued reference to FIG. 5, the sensor pod housing assembly 300 includes a deployable element 310. The deployable element 310 has a first end 301 and an opposite second end 302. As depicted, the first deformable member 231 can be connected or attached to the first end 301 of the deployable element 310. Likewise, the second deformable member 232 can be connected or attached to the second end 302 of the deployable element 310. More specifically, the deployable element 310 differs from the deployable element 210 (shown in FIGS. 2 through 4) inasmuch as the element 310 is adapted for connection to the first and second members 231, 232 at respective first and second ends 301,302 of the element 310, while the deployable element 210 is adapted for connection to the first and second members at the second side, or rear side, of the deployable element 210. The configuration of the sensor pod housing assembly 300 (shown in FIG. 5) can serve to provide a slimmer or thinner profile of the pod 300 compared with that of the pod 200 (shown in FIGS. 2-4). This allows deployment of the apparatus 300 within a relatively narrow borehole.

According to the exemplary embodiment of the disclosure depicted in FIG. 5, the sensor pod housing assembly 300 is configured to function and/or operate in a manner substantially similar to that of the pod assembly 200 depicted in FIGS. 2-4. Operation, or activation, of the first and second actuators 221, 222 can result in movement of the first and second movable portions 251, 252 in respective first and second directions 91, 92, and thus deployment of the sensor pod 310 into contact with the borehole wall (11) of FIG. 1. Such movement of the first and second movable portions 251, 252 can, in turn, result in deflection of the first and second deformable members 231, 232, which can result in deployment or movement of the element 310 in the third direction 93. Biasing action of the first and second deformable members 231, 232 can result in return of the first and second actuators 221, 222 as well as the deployable member 310 to the respective non-activated and non-deployed positions, as is described above with respect to the pod assembly 200 depicted in FIGS. 2-4.

Figure 6:
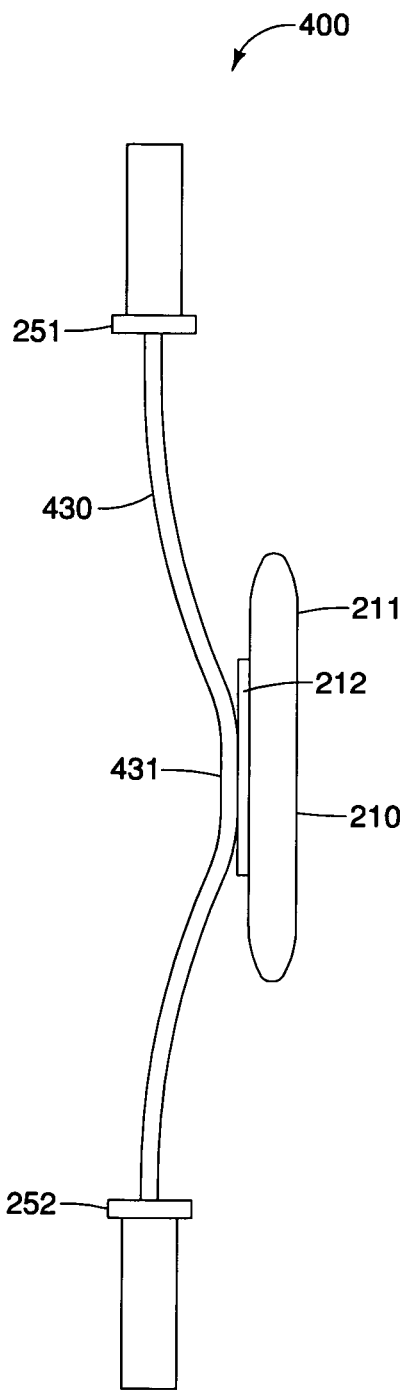
FIG. 6 is a side elevation view of a further alternative embodiment of selected components of a sensor pod housing assembly according to the disclosure.

Turning to FIG. 6, another side elevation view depicts at least a portion of a sensor pod housing assembly 400, which is another alternative embodiment of the sensor pod housing assembly 200 shown in FIGS. 2-4. The sensor pod housing assembly 400 can be configured substantially similarly to, and can include substantially the same components as, the sensor pod housing assembly 200, except as specifically described with respect to FIG. 6. Accordingly, some common components of the pod assemblies 200 and 400 (such as housing 205 of pod assembly 200) are not shown in FIG. 6. The sensor pod housing assembly 400 includes a deployable element 210, which can be substantially identical to the deployable element included in the sensor pod housing assembly 200, which is depicted in FIGS. 2 4. In a comparison of the sensor pod housing assembly 200 (shown in FIGS. 2-4) with the sensor pod housing assembly 400 (shown in FIG. 6), it is seen that the difference is that the sensor pod housing assembly 400 includes a single, unitary deformable member 430 in place of the separate first and second deformable members 231, 232 included in sensor pod housing assembly 200. More specifically, the separate first and second deformable members 231, 232 of sensor pod housing assembly 200 (shown in FIGS. 2-4) have been joined or integrated into the single, unitary deformable member 430, of sensor pod housing assembly 400 (shown in FIG. 6). As depicted, the unitary deformable member 430 can be in the form of a bow spring, and thus has the resilient properties described above with respect to the first and second deformable members 231, 232 of FIG. 2. That is, the unitary deformable member 430 will return to its original shape and position once force exerted by first and second movable portions 251, 252 is removed, thus retracting the deployable element 210 from contact with the borehole wall. The unitary deformable member 430 can be attached or connected to the rear side 212 of the deployable member 210. An attachment point 431 can be defined on the unitary deformable member 430. The deformable member 430 can be attached or connected to the deployable member 210 at the attachment point 431. The attachment point 431 can be substantially in the center of the unitary deformable member 430. The sensor pod housing assembly 400 can be adapted to function and/or operate in a manner substantially identical to that of the sensor pod housing assembly 200 described above with reference to FIGS. 2 4. The advantage of the configuration depicted in FIG. 6 is that it allows for a more compact design (length-wise—i.e., along the length of the borehole 10, FIG. 2), thus allowing for closer spacing of the elements 210 in an array of elements (as per FIG. 1).

Figure 7:
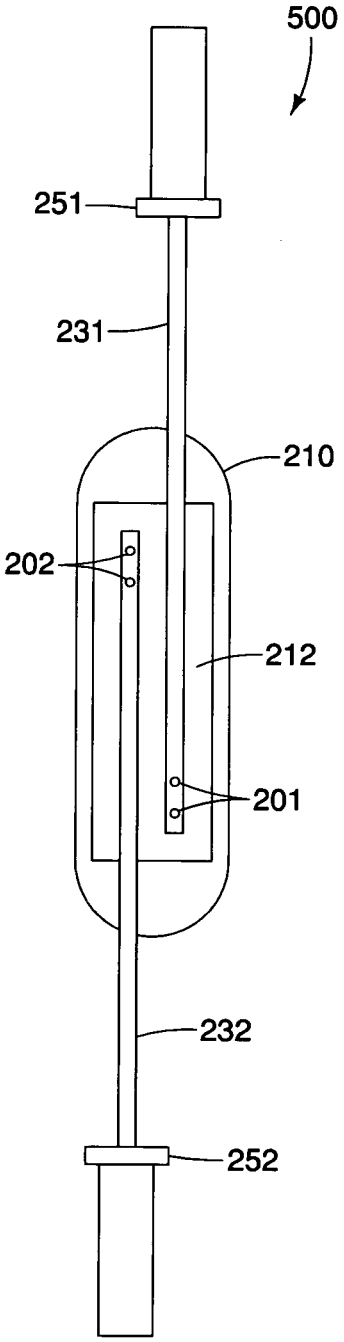
FIG. 7 is a rear elevation view of an alternative component arrangement for a sensor pod housing assembly according to the disclosure.

Turning now to FIG. 7, a side elevation view depicts at least a portion of a sensor pod housing assembly 500 according to at least one additional embodiment of the disclosure. (In this view the sensor pod 210 is seen from the back side or under side—i.e., the side of the sensor pod opposite to the side which will come into contact with the borehole wall when the sensor pod is deployed out of the housing.) The sensor pod housing assembly 500 can be an alternative variation of the sensor pod housing assembly 200 shown in FIGS. 2-4. The sensor pod housing assembly 500 can be configured substantially similarly to, and can include substantially the same components as, the sensor pod housing assembly 200, except as specifically described with respect to FIG. 7. Accordingly, some common components of the sensor pod housing assemblies 200 and 500 are not shown in FIG. 7. With reference to FIG. 7, one or more first connection points, or attachment points 201, can be defined on the first deformable member 231. Similarly, one or more second connection points, or attachment points 202, can be defined on the second deformable member 232. According to the exemplary embodiment of the disclosure depicted in FIG. 7, the first deformable member 231 is attached at one or more of the first attachment points 201 to the deployable element 210. Likewise, the second deformable member 232 can be attached at one or more of the second attachment points 202 to the deployable element 210. As is seen from a study of FIG. 7, the first and second deformable members 231, 232 can be attached to the second side or rear side 212 of the deployable element 210. With continued study of FIG. 7, it is seen that the first and second deformable members 231, 232 can be configured in a substantially overlapping arrangement. More specifically, the first and second deformable members 231, 232 can be connected to the deployable element 210 in a manner wherein one or more of the first connection points 201 are located substantially between the second movable member 252 and one or more second connection points 202. Similarly, the first and second deformable members 231, 232 can be connected to the deployable element 210 in a manner wherein one or more of the second connection points 202 are located substantially between the first movable member 251 and one or more first connection points 201. Such an overlapping arrangement of the first and second deformable members 231, 232 in this manner can facilitate a shorter or less elongated sensor pod housing assembly 500 as compared with the sensor pod housing assembly 200 (shown in FIGS. 2-4), or even the sensor pod housing assembly 400 of FIG. 6.

Figure 8:
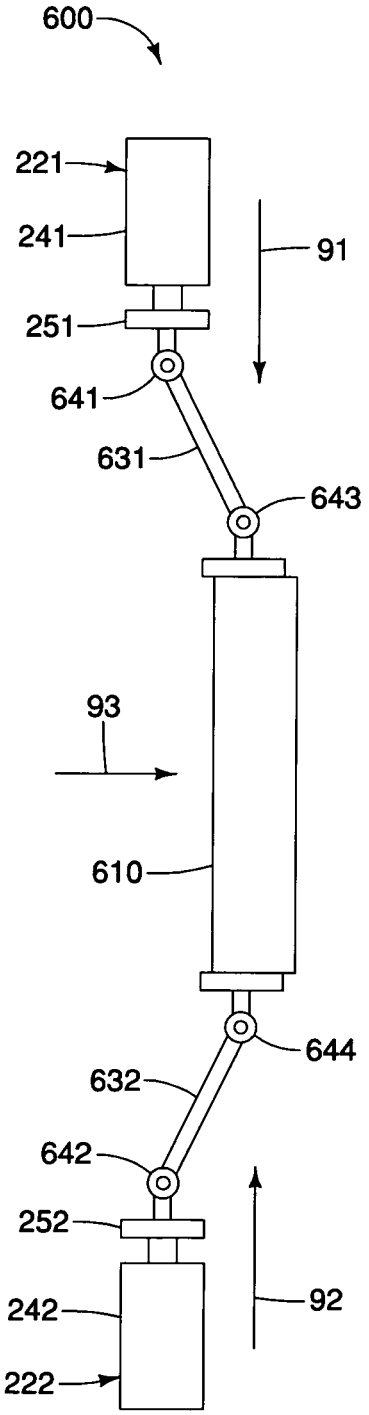
FIG. 8 is a side elevation view of an alternative embodiment of sensor pod housing assembly components according a further embodiment of the disclosure.

Turning now to FIG. 8, a side elevation view of at least a portion of a sensor pod housing assembly 600 is shown according to at least one further embodiment of the disclosure. The sensor pod housing assembly 600 can be an alternative variation of the sensor pod housing assembly 200 shown in FIGS. 2-4. The sensor pod housing assembly 600 can be configured substantially similarly to, and can include substantially the same components as, the sensor pod housing assembly 200, except as specifically described with respect to FIG. 8. Accordingly, some common components of the sensor pod housing assemblies 200 and 600 are not shown in FIG. 8. The sensor pod housing assembly 600 can include first and second actuators 221, 222, which are described herein with respect to FIGS. 2-4. With reference to FIG. 8, the sensor pod housing assembly 600 includes a deployable element 610. The sensor pod housing assembly 600 includes a first link 631 and a second link 632. The first and second links 631, 632 are substantially rigid according to the exemplary embodiment of the disclosure depicted in FIG. 8. More specifically, the first and second links 631, 632, respectively, are adapted to substantially resist deformation and/or deflection when employed as described herein.

The first link 631 is connected between the first actuator 221 and the deployable element 610. The second link 632 is connected between the second actuator 222 and the deployable element 610. In accordance with at least one embodiment of the disclosure, the first link 631 is pivotably connected between the first actuator 221 and the deployable element 610, while the second link 632 is pivotably connected between the second actuator 222 and the deployable element 610. More specifically, the first link 631 is connected at a first end to the moveable portion 251 of the first actuator 221 by a first pivot joint 641. A spacer (not numbered but shown in FIG. 8) can be placed between the moveable portion 251 and the first pivot joint 641. The first link 631 is further connected at a second end to the deployable element (sensor pod) 610 by a second pivot joint 643. Likewise, the second link 632 is connected at a first end to the moveable portion 252 of the second actuator 222 by another first pivot joint 642, and the second link is further connected at a second end to the deployable element 610 by another second pivot joint 644. Thus, the sensor pod housing assembly 600 includes two links 631, 632, each link being connected (either directly or indirectly) at a first end of the link to the respective actuator movable portion (251, 252) by a first pivot joint (respectively, first joints 641 and 642). Further, the two links 631, 632 of the sensor pod housing assembly 600 are connected at respective second ends of the links to the deployable element 610 via respective second pivot joints 643 and 644. It will be observed that preferably the links 631, 632 are connected between the moveable portions 251, 252 of actuators 221, 222 and the deployable element 610 at an angle such that there is no binding of the components during actuation. Further, the mounting angle of the links is selected to cause the deployable element 610 to move outward (i.e., in direction 93) upon actuation of the actuators 221 and 222.

As is described herein with respect to FIGS. 2-4, each of the first and second actuators 221, 222 can be selectively actuated, or operated, to cause the first movable portion 251 and the second movable portion 252 to move substantially in the first direction 91 and in the second direction 92, respectively. A study of FIG. 8 reveals that operation of the first and second actuators 221, 222 can cause the first movable portion 251 and the second movable portion 252 to move substantially toward each other (in respective directions 91 and 92). Such movement of the first movable portion 251 and the second movable portion 252 can result in rotation of the first link 631 in a counterclockwise direction about pivot joint 641 (as viewed in FIG. 8), and can result in rotation of the second link 632 in a clockwise direction about pivot joint 642 (as viewed in FIG. 8). Operation of the first and second actuators 221, 222 can also result in movement of the deployable element 610 substantially in the third direction 93. The sensor pod housing assembly 600 can include one or more biasing members (not shown in FIG. 8, but described below with respect to FIGS. 9A and 9B) such as one or more springs or the like, which are adapted to cause the first and second actuators 221, 222, when they are deactivated, to return to their respective non-actuated positions as depicted in FIG. 8. According to at least one embodiment of the disclosure, each of the first and second actuators 221, 222 can include an integral return spring adapted to cause the actuators to substantially return to their respective deactivated positions.

Figure 9:
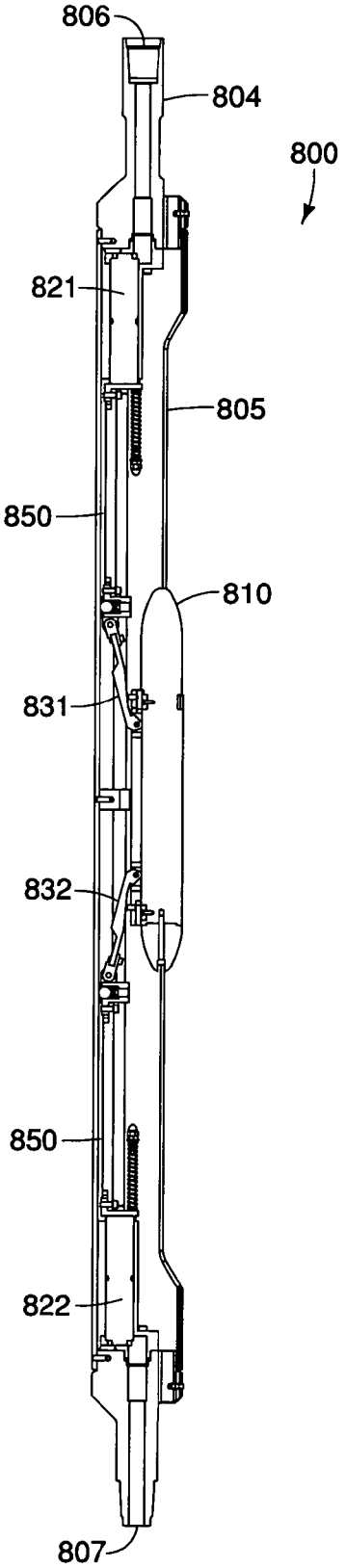
FIG. 9 is a side elevation view of another embodiment of a sensor pod housing assembly according to the disclosure.
Figure 9A:
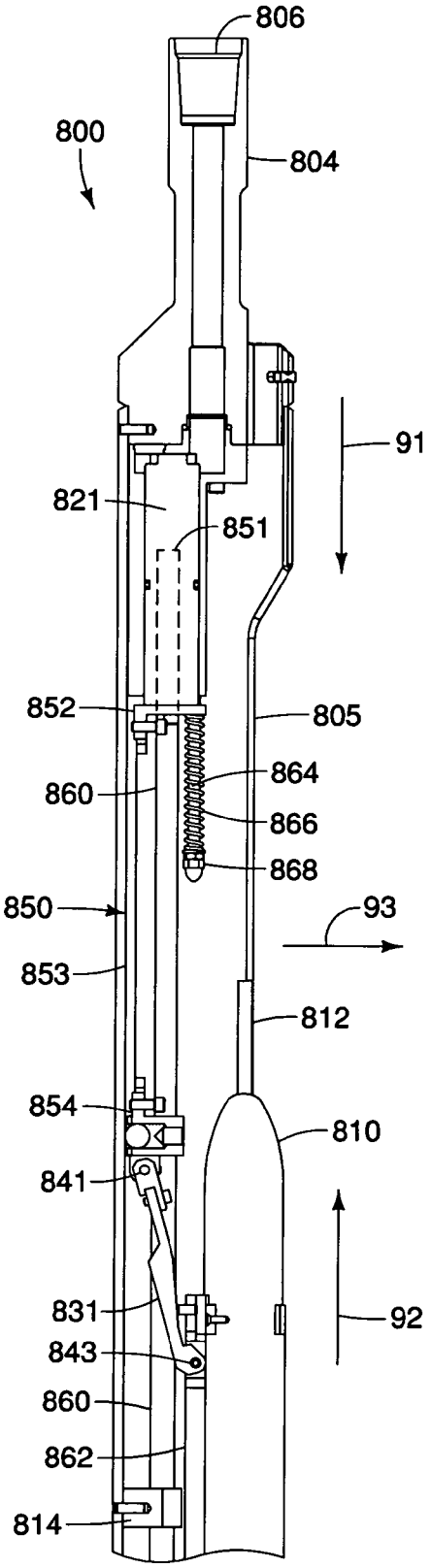
FIG. 9A is a side elevation detail of the sensor pod housing assembly configuration depicted in FIG. 9.

Turning now to FIG. 9, a side elevation view of an optional arrangement to that depicted in FIG. 8 is shown. The apparatus depicted in FIG. 9 includes sensor pod housing assembly 800 (similar in a basic way to sensor pod housing assembly 600 of FIG. 8). Sensor pod housing assembly 800 includes deployable element or sensor pod 810, which is at least partially received within housing 805 (as depicted in FIG. 9 in the non-deployed state). Sensor pod housing assembly 800 further includes respective first and second actuators 821 and 822 (generally similar to respective first and second actuators 221 and 222 of FIGS. 2-5 and 8), as well as respective associated first and second links 831 and 832 (generally corresponding to first and second links 631 and 632 of FIG. 8). The links 831 and 832 are connected to the actuators (respectively, 821 and 822) by moveable portions 850. I will refer to the combination of the actuators (821, 822), the moveable portions 850, and the links (831,832) as the deployment apparatus. The sensor pod housing assembly 800 further includes first and second fluid openings 806 and 807 which allow hydraulic fluid to move between plural units of the sensor pod housing assembly 800 (as per the arrangement depicted in FIG. 1). A detail of FIG. 9 is provided as the side elevation view in FIG. 9A, which generally provides for an enlargement of the upper portion of the sensor pod housing assembly 800 depicted in FIG. 9. It will be appreciated that the upper portion of the assembly 800 of FIG. 9 (which is depicted in FIG. 9A) is essentially a mirror image of the lower portion of the assembly 800 of FIG. 9 (with the exception of minor details, such as: (i) the fluid opening 806 is a female fitting, whereas the fluid opening 807 is a male fitting; and (ii) the sensor pod 810 may or may not be symmetrical, although in one embodiment the sensor pod is symmetrical with the signal tubing 812 attached to the center of each end of the sensor pod 810).

With respect to FIG. 9A, the first actuator 821 includes a fluid manifold (also numbered as 821) which receives piston 851. The actuator/manifold 821 is configured to received hydraulic fluid passing through (i.e., into, in the case of actuation) the fluid opening 806 formed in the housing end piece 804. The actuator/manifold (or manifold) 821 is provided with internal fluid ports (not shown) to direct the hydraulic fluid entering the manifold to a first end of the piston 851 received within the manifold, as well as to the hydraulic tubing 860. Hydraulic tubing 860 allows hydraulic fluid to be communicated between plural in-line units of the sensor pod housing assembly 800 (as per the arrangement depicted in FIG. 1). Thus, when hydraulic fluid volume and pressure at the fluid opening 806 are increased, hydraulic fluid will not only exert force against the piston 851 in actuator/manifold 821, but will also provide fluid volume and force to the piston (not shown) in actuator 822 (FIG. 9), as well as to actuators in connected assembly units (per FIG. 1).

With continued reference to FIG. 9A, and as indicated above, the deployment apparatus (not numbered) of the assembly 800 includes the combination of the actuators (821, 822), the moveable portions 850, and the links (831,832) of FIG. 9. The moveable portion 850 of the assembly 800 depicted in FIG. 9A includes: (i) the piston 851; (ii) the piston return bracket 852; (iii) the pusher bar 853; and (iv) the carriage 854. (Essentially identical components are provided for the moveable portion 850 connected to actuator 822 of FIG. 9). In this exemplary depiction of the moveable portion 850 the piston return bracket 852 is secured to the end of the piston 851 which protrudes from the actuator/manifold 821. This can be done, for example, by securing the piston return bracket 852 to the piston 851 using screws, bolts, pins, or by welding. Preferably, the piston return bracket 852 is secured to the piston 851 using screws to allow for ease of assembly and disassembly of the deployment apparatus. Likewise, the pusher bar 853 can be secured to the piston return bracket 852 by means such as screws, bolts, pins, or by welding. Preferably, the piston return bracket 852 is secured to the pusher bar 853 using screws to allow for ease of assembly and disassembly of the deployment apparatus. In similar manner, the carriage 854 can be secured to the pusher bar 853 by means such as screws, bolts, pins, or by welding. Preferably, the pusher bar 853 is secured to the pusher carriage 854 using screws to allow for ease of assembly and disassembly of the deployment apparatus.

As is further depicted in FIG. 9A, the carriage 854 is connected to the first link 831 (and at a first end of the first link) by a first pivot joint 841. The first link 831 is then connected (at a second end of the first link) to the sensor pod support platform 862 by second pivot joint 843. That is, respective first and second pivot joints 841, 843 connect the first link 831 to (respectively) the carriage 854 and the sensor pod support platform 862. Thus, and as can be appreciated from FIG. 9A, hydraulic fluid pressure applied to a first end of the piston 851 (received within actuator/manifold 821) will cause the piston to move in direction 91, thus urging the connected piston return bracket 852, the pusher bar 853, and the carriage 854 to exert force on the first pivot joint 841. This force applied to the first pivot point 841 will be communicated to the first link 831, and thus to the sensor pod support platform 862 via the second pivot joint 843. This force will be opposed by an essentially equal and opposing force applied via the second actuator 822 (and accompanying moveable components 950, per FIG. 9). The result being that the links

831 and 832 will apply essentially equal and opposing forces to the opposite ends of the sensor pod support platform 862 in directions 91 and 92, thus forcing the sensor pod support platform 862 (and the sensor pod 810 supported thereon) in direction 93. This arrangement of having two opposing active forces (as applied by actuators 821 and 822) forcing the sensor pod 810 in outward direction 93 results in a greater coupling force being applied to the sensor pod 810 with the inner wall 11 (FIG. 1) of the wellbore 10, and thus improved signal reception by sensors embedded within the sensor pod 810. More specifically, the two opposing active forces (as applied by actuators 821 and 822, as well as actuators in other embodiments depicted in the figures and described herein) are aligned essentially axially with: (i) the housing 805; and (ii) the sensor pod 810.

With further reference to FIG. 9A, the sensor pod housing assembly 800 can further include a support block 814 which is positioned within the housing 805 and is configured to support the sensor pod support platform 862 when the deployment apparatus (moveable portions 850, etc., as described above) are in a non-deployed state. The support block 814 limits movement of the sensor pod support platform 862 into the housing 805 to ensure that the sensor pod support platform (and thus, the sensor pod 810) do not become locked in an immovable position. That is, the links 831, 832 are to preferably maintained at an angle with respect to the linear orientation of the assembly 800 when in a non-deployed configuration (as depicted in FIGS. 9 and 9A). This angular orientation of the links 831, 832 between the carriages (carriage 854 of FIG. 9A, and the corresponding, but not numbered, carriage depicted in FIG. 9) and the sensor support platform 862 ensure that the platform 862 will be deployed in direction 93, and that no binding will occur between the links 831, 832 and the other components of the deployment apparatus (including support platform 862) during deployment. The support block 814 ensures this operation by limiting downward travel (i.e., travel in a direction opposite to direction 93) of the sensor pod support platform 862.

As is further depicted in FIG. 9A, the exemplary sensor pod deployment assembly 800 includes a return spring 866 which is configured to apply a positive force to withdraw the sensor pod 810 from contact with the borehole wall 11 (FIG. 1) once hydraulic fluid pressure applied to actuator/manifold 821 is relieved. In the example depicted in FIG. 9A, the return spring 866 is a coil spring supported on a spring support 864, with the coil spring 866 being positioned between the piston return bracket 852 and an end-cap 868 fixed on the spring support 864. In this example, as the piston return bracket 852 moves in direction 91 (by way of forces being applied to the piston return bracket by connected piston 851), the coil spring (return spring) 866 will be compressed between the piston return bracket 852 and the end cap 868. Then, when hydraulic pressure is relieved on the piston 851 within the actuator/manifold 821 the return spring 866 will cause the piston return bracket 852 to move in a direction opposite to direction 91, thus actively withdrawing the connected sensor pod support platform 862 (and thus the associated sensor pod 810) by way of the associated connections there between (i.e., carriage 854, pusher bar 853, etc. as described above). This action is further essentially simultaneously performed with respect to relief of hydraulic pressure on the opposing actuator/manifold 822 (and accompanying opposing return springs, not numbered) to apply forces in a direction opposite to direction 92, thus resulting in essentially opposite and opposing forces being applied to the links 831 and 832 (in respective directions 92 and 91) in order to force movement of the sensor pod 810 to withdraw (i.e., move in a direction away from direction 93).

Thus, as can be appreciated, the apparatus depicted and described with respect to FIGS. 9 and 9A provides for the following: (i) essentially equal and opposite deployment forces to be applied to both ends of a sensor pod 810 (via actuators 821 and 822 and associated links 831 and 832) resulting in improved coupling forces applied to the sensor pod with the borehole wall 11 (FIG. 1); and (ii) essentially equal and opposite sensor pod withdrawal forces being applied to actively and completely withdraw the sensor pod (810) from contact with the borehole wall. FIG. 9A also shows signal cable housing 812 which can be a housing (such as a stainless steel tube or the like) to enclose and protect signal lines leading from the from the sensor pod (810, for example) to a signal receiving station (119, FIG. 1). The signal lines within signal cable housing 812 can be, by way of example, optical fibers and/or electrical wires.

Figure 9B:
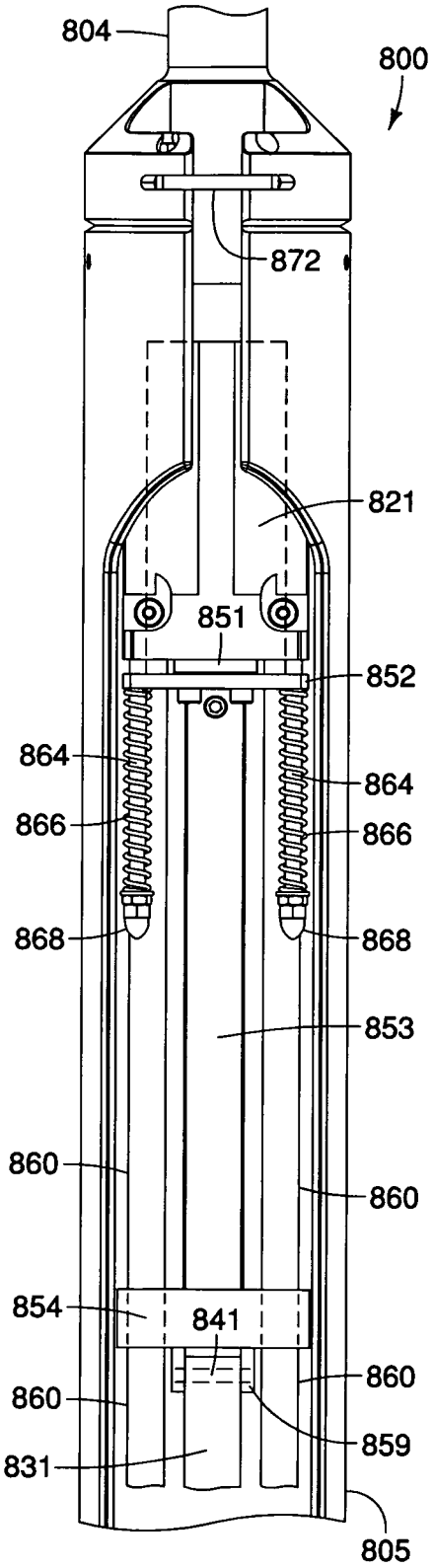
FIG. 9B is a right side plan view of the detail portion of the sensor pod housing assembly depicted in FIG. 9A.

Turning now to FIG. 9B, a plan view of the sensor pod housing assembly 800 of FIG. 9A is depicted. For ease of viewing, the sensor pod 810 of FIG. 9A has been removed from the view of FIG. 9B. Also in FIG. 9B, a portion of the piston 851 is shown slightly protruding from actuator/manifold 821. As can be seen, the piston return bracket 852 is secured to the piston 851 by two fasteners (not numbered) such as screws, and the pusher bar 853 is also secured to the piston return bracket 852 by a fastener (also not numbered). As can also be seen in FIG. 9B, there are two essentially parallel hydraulic lines 860 which are connected to the manifold 821 and run lengthwise along the interior of the housing 805, and the pusher bar 853 is positioned between the hydraulic lines 860. Further, there are two essentially parallel return string supports 864 which are supported by the manifold 821, each spring support supporting a return spring 866 held in place by an end cap 868. This arrangement is essentially replicated in mirror image on the right end (bottom half) of the assembly 800 (not shown in FIG. 9B), and thus in the example depicted there are four return springs 866. This configuration allows for smaller springs 866 to be used (versus two larger springs), while still achieving sufficient force to retract the sensor pod 810 once hydraulic pressure is released in the manifold 821. The use of four smaller springs 866 not only facilitates a smaller diameter design for the assembly 800 (versus using two larger springs), but also applies a more balanced force to the piston return bracket 852, thus reducing the likelihood that the piston 851 will bind in the actuator/manifold 821 during retraction of the piston.

FIG. 9B further depicts the carriage 854 which is attached to the pusher bar 853 on the left side (upper end) of the carriage, and the link 831 which is attached by pivot joint 841 to the right side (bottom end) of the carriage. The pusher bar 853 and link 831 are preferably attached to the carriage 854 using removable fasteners such as screws (not shown in FIG. 9B) for the purpose of facilitating assembly of the moveable portion 850 (FIG. 9A) within the housing 805. As is shown in FIG. 9B, the link 831 is positioned between the hydraulic lines 860.

Figure 9C:
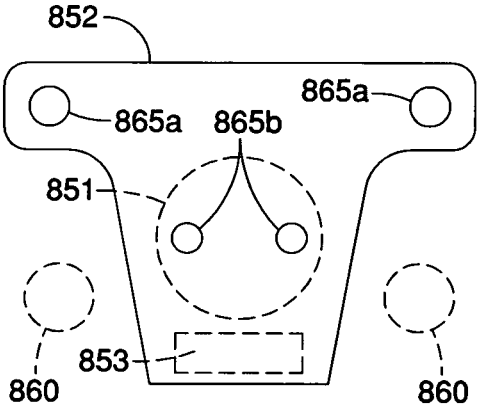
FIG. 9C is a front view of the piston return bracket depicted in FIG. 9B.

The arrangement of components depicts in FIGS. 9A and 9B is facilitated by viewing FIG. 9C, which is an end view of the piston return bracket 852. The piston return bracket 852 of FIG. 9C includes two return spring support openings 865*a*, such that the bracket 852 rides along the spring supports 864 (FIG. 9B). The spring support openings 865*a* are sized such that the springs 866 (FIG. 9B) do not pass through the openings 865*a*, and thus the springs exert their return force against the face of the bracket 852. The piston return bracket 852 is secured to the piston 851 (shown in phantom lines) on the backside of the bracket 852 by fasteners (not shown) which pass through piston attachment holes 865*b*. The pusher bar 853 (FIG. 9B), shown in phantom lines in FIG. 8C, is secured to the piston return bracket 852 (preferably by removable fasteners, not shown). The piston return bracket 852 is shaped such that the hydraulic lines 860 (shown in phantom lines) pass outside of the bracket. While the bracket 852 can be shaped such that the hydraulic lines 860 pass through openings in the bracket 852, the arrangement depicted in FIG. 9C ensures that the bracket will not bind against the hydraulic lines 860 as a result of a turning moment applied to the bracket by the return springs 866 (FIG. 9B) pressing against the upper portion of the bracket 852.

Figure 9D:
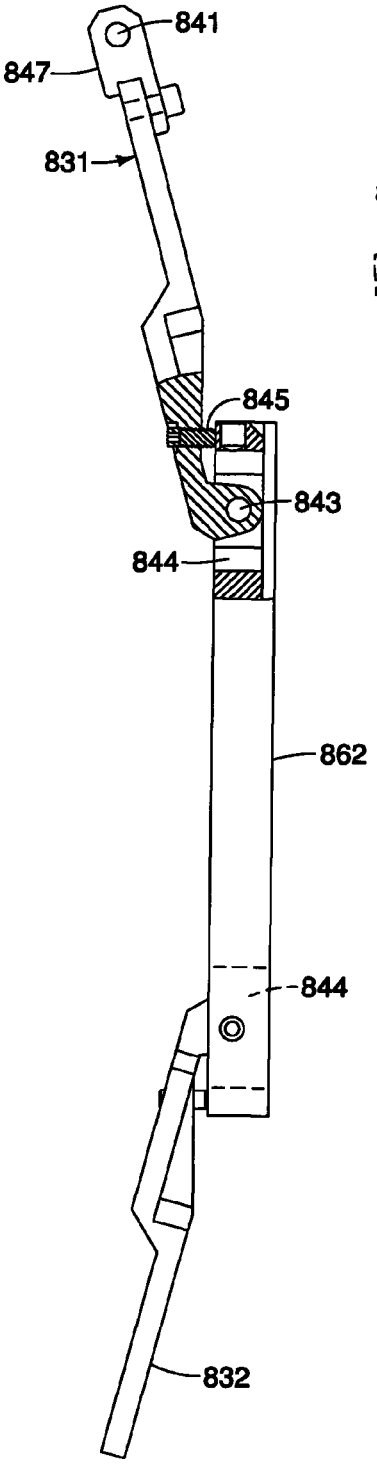
FIG. 9D is a side view of the link and sensor pod support platform assembly depicted in FIG. 9.

FIG. 9D is a side view of the assembly of the links 831, 832 (FIG. 9) and the sensor pod support platform 862 (FIG. 9A). The left (or upper) link 831 includes link mounting bracket 847 which is secured to the body of the link 831 by a removable fastener (shown but not numbered). The link mounting bracket 847 fits about first pivot joint 841, which is in turn connected to the pusher bar 853 (FIGS. 9A, 9B). A similar arrangement is provided for the second link 832. The platform 862 includes link openings 844 which are disposed between the side edges of the platform. The link openings 844 receive the second ends of the links 831, 832, and the links are held in place in the sensor support platform 862 by the second pivot joints (such as second pivot joint 843 for link 831). Although not visible from FIG. 9D, the ends of the links 831, 832 that fit within the link openings 844 are narrowed in width from the main body of the links (in order to allow the link ends to be received in the openings 844), but the link ends are also thickened in height (over the thickness of the main body) to provide sufficient cross section throughout the link that the link does not buckle or bend during use. Allowing the second ends of the links 831, 832 to be received in the link openings 844 allows the sensor pod housing assembly 800 (FIG. 9) to be of a smaller diameter than if the links 831, 832 were attached to the bottom of the platform 862. Each link 831, 832 can also be provided with leveling screws 845 to allow the platform 862, and a sensor pod (810, FIG. 9A) to be leveled during assembly and thus improve contact with a borehole wall (11, FIG. 1).

Figure 9E:
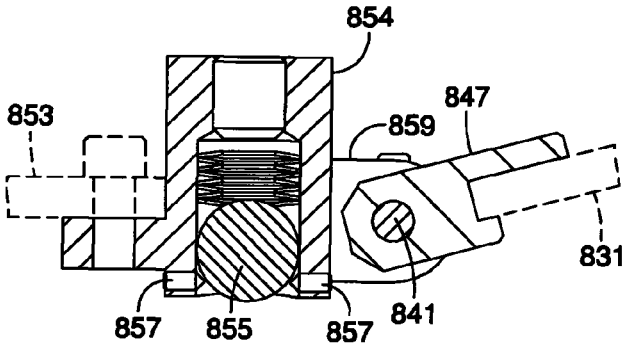
FIG. 9E is a cross sectional side view of a carriage used in the assembly depicted in FIG. 9A.

Now turning to FIG. 9E, a side cross section of the carriage 854 of FIGS. 9A and 9B is depicted. As shown, the pusher bar 853 is connected to the carriage 854 at a first side of the carriage, and the link 831 is connected to the other side of the carriage by link mounting bracket 847. More specifically, link mounting bracket 847 is supported between parallel link mounting flanges 859 (both of which are depicted in FIG. 9B) by first pivot joint 841. In the example depicted in FIG. 9E, the main body of the carriage 854 includes a hollow portion which receives ball bearing 855, which is retained within the hollow portion by retaining pins 857. A spring (not numbered) is placed in the hollow portion above the bearing 855, thus pushing the bearing 855 outward from the body of the carriage 854. In use, the carriage 854 rides along the bearing 855 on the inside of the housing 805 (FIG. 9A). Not shown in FIG. 9E are hydraulic line passage openings formed in the carriage 954 which allow the carriage to ride along the hydraulic lines 860 (FIGS. 9A and 9B) during movement of the carriage. Allowing the carriage 854 to ride along the hydraulic lines 860 provides two advantages: (i) the carriage tends to hold the hydraulic lines in place within the housing 805 (see FIG. 9B); and (ii) the hydraulic lines 860 provide guides for the carriage 854 to reduce roll of the carriage around the inside of the housing 805 during movement of the carriage.

Figure 9F:
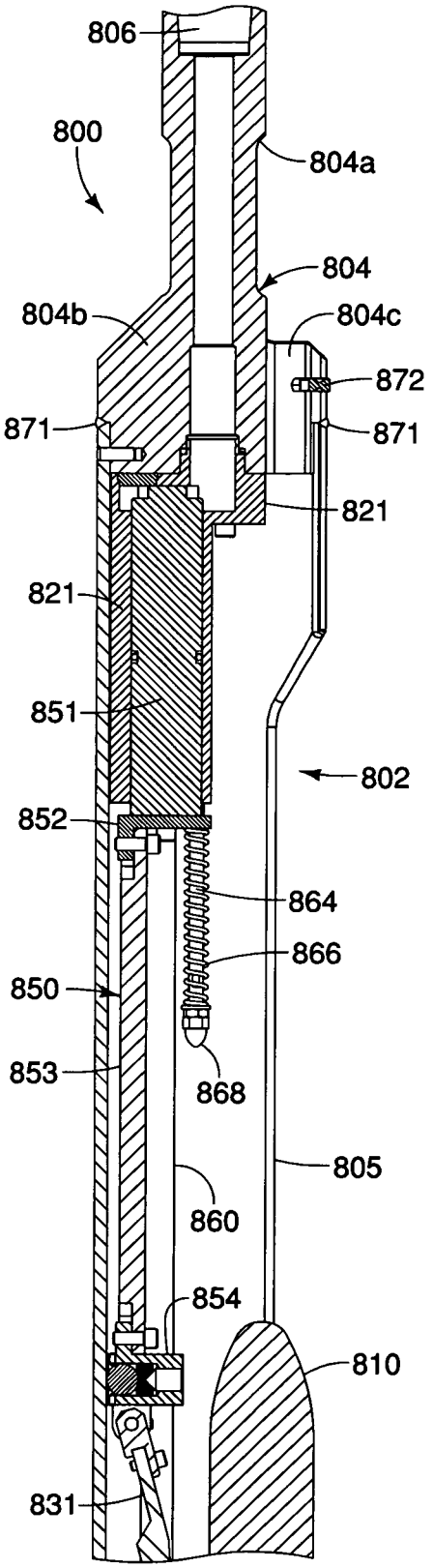
FIG. 9F is a side sectional view of the detail depicted in FIG. 9A.

Moving now to FIG. 9F, this figure is an enlarged sectional view along the centerline of part of FIG. 9B, and further including a portion of FIG. 9A. Several of the reference numbers provided on FIG. 9F are not mentioned in the following discussion, but have been previously described (with respect to FIGS. 9 and 9A through 9E), and are included for purposes of ease of cross reference with the above-described figures. With reference to FIG. 9F, the sensor pod housing assembly 800 includes the housing 805, the housing end piece 804, the actuator/manifold 821, the moveable portion 850 of the actuator, the sensor pod 810, and a part of the first link 831. (As previously described, the moveable portion 850 of the actuator includes the piston 851, the piston return bracket 852, the pusher bar 853, and the carriage 854.) FIG. 9F shows one of the hydraulic lines 860 which receives hydraulic fluid from the manifold 821. In the sectional view shown in FIG. 9F the fluid communication channels forming a fluidic connection between the fluid opening 806 and the fluid conduit 860 is not shown, since such fluid communication channels are located on opposite sides of the piston 851.

In the exemplary arrangement depicted in FIG. 9F, the housing end piece 804 is a continuous component (preferably machined from a cylindrical piece of high strength steel) which includes the following portions: (i) the end piece fluid line connector portion 804*a*; (ii) the end piece main body portion 804*b*; and (iii) the end piece access passageway 804*c*. The end piece fluid line connector portion 804*a* defines the fluid opening 806 through which hydraulic fluid is provided to the manifold 821. The end piece fluid line connector portion 804*a* includes a threaded connector section (not numbered, but at the upper end of FIG. 9F) allowing the end piece connector portion 804*a* to be connected to a pipe or conduit (e.g., 831, 832, FIG. 1) which connects (both mechanically and fluidicly) the housing assembly 800 to other housing assemblies. The housing 805 of FIG. 9F (and FIGS. 9, 9A and 9B) can be fabricated from well liner material, known as well casings, such as nominal 4 to 8 inch outside diameter well liner material using either a J55, N80 or P110 quality steel, by way of example. Well liner material is essentially pipe fabricated from steel alloy intended to be placed within a wellbore, and is thus metallurgically selected to withstand the environment intended to be encountered within a well bore. For use in the sensor pod housing assembly 800, the well liner material (used for housing 805) is modified by cutting away a portion of the liner in order to form a housing opening 802. The housing opening 802 not only provides an opening which allows sensor pod 810 to be deployed outside of the housing 805, but also allows the various components (actuator/manifold 821, moveable portion 850, links 831, 832, platform 862 (FIG. 9A), sensor pod 810, and sensor signal line 812 (FIG. 9A)) to be installed within the housing 805. (As described above, in the non-deployed state the sensor pod 810 resides within the housing 805 such that the sensor pod does not make contact with the borehole wall 11 (FIG. 1) when the assembly 800 is traversing the borehole (10, FIG. 1).)

In the example shown in FIG. 9F, the housing end piece 804 is connected to the housing 805 by a circumferential weld 871. (In FIG. 9F the weld 871 is depicted as protruding slightly above the outer surface of the housing 805, but in practice the weld is preferably ground smooth with the outer surface of the housing.) FIG. 9F shows a gate 872 which is better understood with reference to FIG. 9G.

Figure 9G:
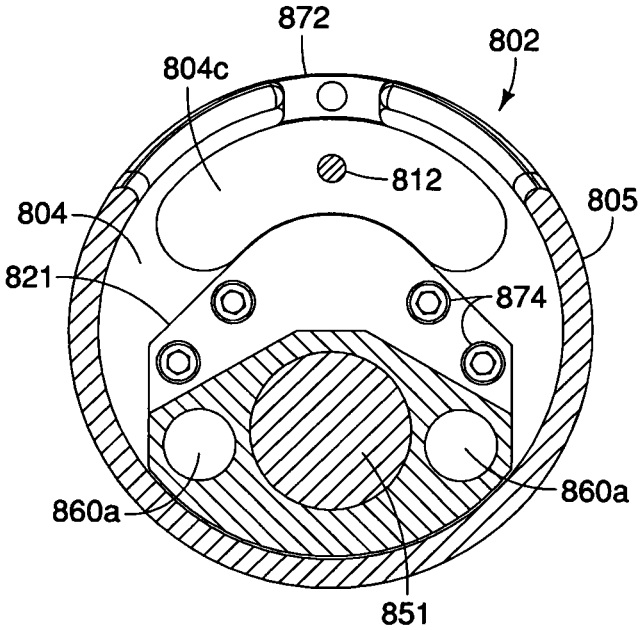
FIG. 9G is an end sectional view of the detail depicted in FIG. 9A.

FIG. 9G is an end sectional view of the sensor pod housing assembly 800 of FIG. 9F, with the section taken through the actuator/manifold 821. As can be seen from the cross sectional lines on the housing 805 in FIG. 9G, there is an open area (the housing opening 802 of FIG. 9F) in approximately the upper fourth of the housing. FIG. 9G also shows the piston 851 within the actuator/manifold 821, as well as the fluid passageways 806*a* which communicate with the hydraulic tubing (860, FIG. 9B). Also visible in FIG. 9G are the fasteners 874 used to secure the manifold 821 to the housing end piece 804. The housing end piece access passageway 804*c* is also clearly visible in FIG. 9G. The signal conduit 812 is depicted as being received with the access passageway 804*c*. A hinged gate 872 prevents the signal conduit from passing outside of the housing 805 when the sensor pod 810 (FIG. 9F) is deployed. The gate 872 is preferably secured in the closed position by a pin or other means (not shown in FIG. 9G). The end piece access passageway 804*c* allows the sensor pod housing assembly 800 to move freely in a fluid-filled wellbore since fluid can move through the passageway 804*c* as the apparatus 800 is moved upward and downward within the wellbore (as depicted in FIG. 1).

Figure 9H:
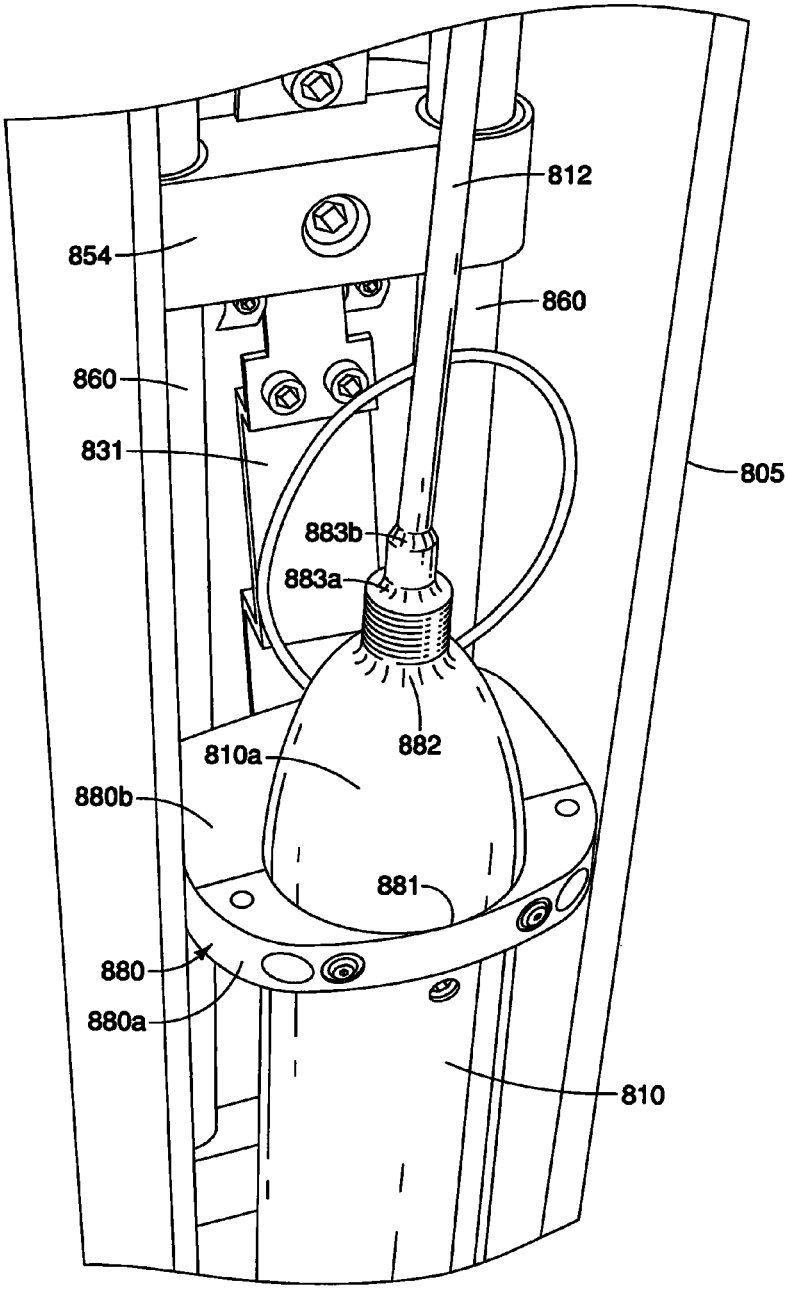
FIG. 9H is a three-quarter partial top view of a portion of the sensor pod assembly depicted in FIG. 9A.

FIG. 9H is a three-quarter partial top view of a portion of the sensor pod assembly 800 of FIG. 9A. FIG. 9H shows a portion of the housing 805, the carriage 854, the first link 831, the hydraulic tubing 860, and the sensor pod 810. Also depicted is a portion of the signal tubing 812, which is connected to the sensor pod 810. The sensor pod 810 includes a recessed portion 881 located between the main body portion of the sensor pod and the sensor pod front section 810*a*. In this exemplary arrangement a two-part sensor pod clamp 880 is used to secured the sensor pod 810 to the sensor pod platform 862 (FIGS. 9A and 9D, but not visible in FIG. 9H). The sensor pod clamp 880 has a first clamp part 880*a* which fits into the recess 881 in the sensor pod 810, and a lower clamp part 880*b* which fits under the platform (862, FIG. 9A). The sensor pod clamp parts 880*a* and 880*b* are joined together by fasteners (shown, but not numbered). A similar arrangement to that depicted in FIG. 9H can be used for securing the opposite end of the sensor pod 810 (not shown in FIG. 9H) to the support platform 862 within the housing 805. It will be appreciated that if either sensor pod 810, or sensor pod clamp 880 (or two corresponding sensor pod clamps 880 for a single sensor pod 810) make secure contact with a borehole wall (11, FIG. 1), then the seismic (and other) signals that are communicated to the borehole wall will be communicated to the sensor pod 810, and thereafter relayed to a data collection processor (e.g. 119, FIG. 1).

A further embodiment of the present disclosure is depicted in-part in FIG. 9H. The embodiment provides for a weld-sealed arrangement of sensor pods and signal line tubing in an overall sensor apparatus 100 (FIG. 1). Specifically, and with respect to FIG. 9H, the sensor signal line tubing 812 can be connected to the front part 810*a* of the sensor pod 810 by welds 882, 883*a* and 883*b*. (Similar weld connections of the signal line tubing 812 to the back part of the sensor pod 810 (not shown or numbered in FIG. 9H) can also be provided.) Also, the sensor pod 810 can be entirely weld-sealed, such that there are no screwed, threaded or other connections that can be broken without cutting into the sensor pod 810. Thus, by using welded connections for the sensor pod (810), and between the sensor pod and the signal tubing (812), an integrated inline weld-sealed series of sensor pods and signal line tubing can be provided. In a preferred embodiment, all of the sensor pods (e.g., 210, FIG. 1) are linked together via signal lines encompassed within a single signal line tubing (e.g., signal line tubing 118, FIGS. 1, and 812, FIG. 9A). Preferably, the sensor pod 810 (FIG. 9H) and the signal tubing 812 are concentrically symmetrical with one another about a centerline passing through the sensor pod and the signal tubing. Further, the sensor pod 810 is preferably of a cylindrical shape, with end-to-end symmetry (the ends, only one of which is depicted in FIG. 9H as item 810*a*) preferably being of a tapered conical or hemispherical shape. This arrangement (of placing the sensor pod 810 and the signal tubing 812 in a symmetrical arrangement) allows for the use of an orbital welder to make the welds 882, 883*a* and 883*b* of FIG. 9H. In this way (i.e., by providing for symmetrical alignment and orientation of the sensor pods 810 and the signal tubing 812, and providing a cylindrical shape for the sensor pod) the weld-sealed combination of sequential sensor pods (810) and signal tubing (812) can be performed using an economical welding process (i.e., via an orbital welder). This configuration (i.e., of using weld-sealed connections in a sensor pod to sensor tubing connection) is opposite of prior art configurations which use screwed connections between: (i) sensor pod assembly components (e.g., between the main body of the sensor pod 810 and the front piece or portion 810*a* of the sensor pod); and (ii) between the sensor pod and the signal line tubing 812. The prior art use of screwed connections allows for easier repair of the sensor pod and signal lines over welded connections. However, I have discovered that the use of welded connections leads to fewer components failures in the sensor pod and signal lines since fluid within the wellbore cannot enter into the sensor pod and signal line tubing when welded connections are used.

Figure 13:
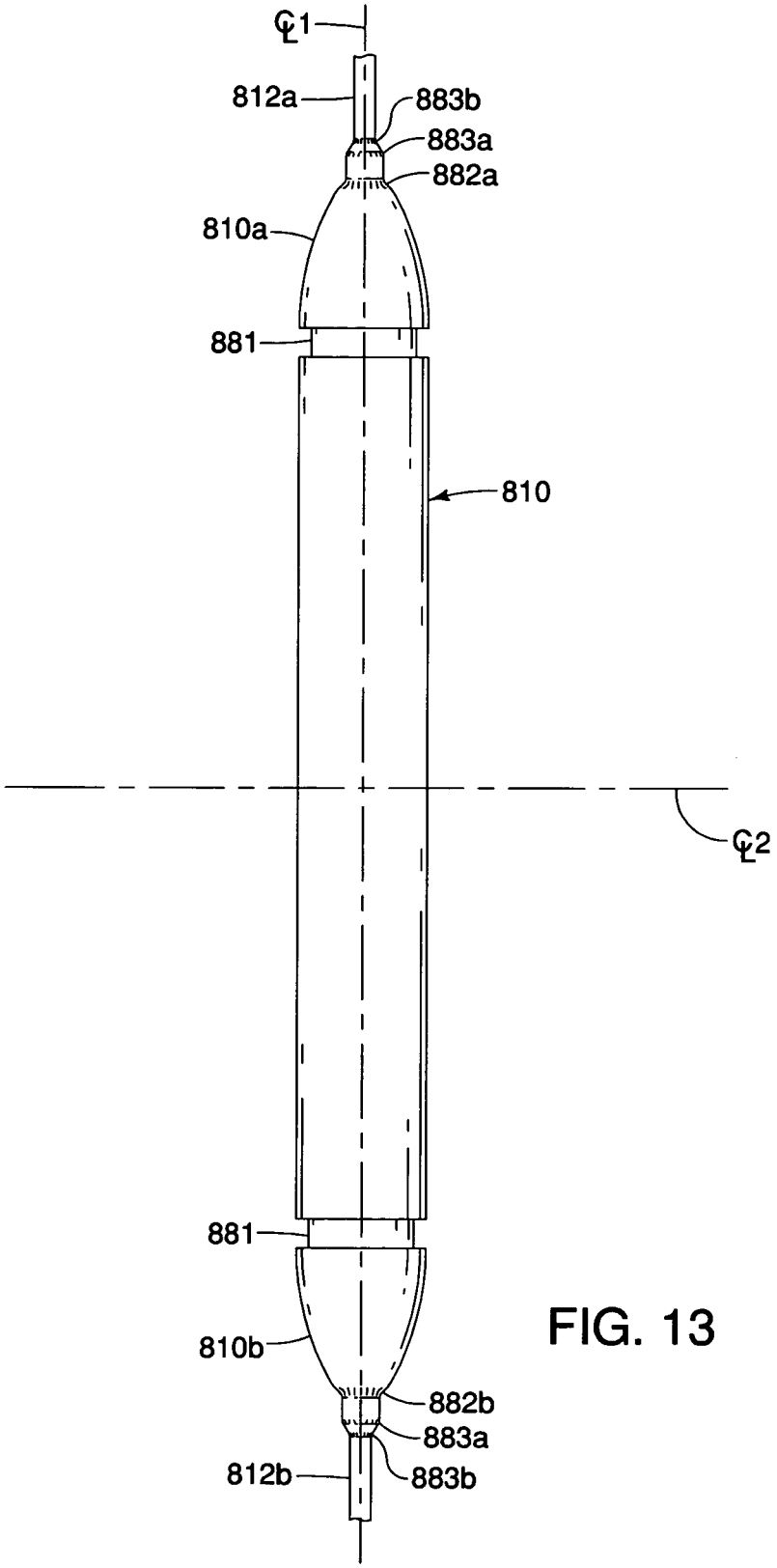
FIG. 13 is a plan view of a sensor pod and sensor tubing assembly in accordance with the present disclosure.

The present disclosure thus also provides for a sensor pod 810 as depicted in FIG. 13 (and also in FIG. 9H). The sensor pod 810 can have cylindrical symmetry about an axial center line CL1 which is in alignment with signal tubing 812*a* and 812*b* which are connected to the sensor pod at opposite ends (810*a*, 810*b*) of the sensor pod. The sensor pod 810 can also have end-to-end symmetry about a second center line CL2 (which is perpendicular to CL1). The sensor pod 810 can include recesses 881 to receive sensor pod mounting brackets (one of which is depicted in FIG. 9H as item 880). In a preferred fabrication process, the sensor pod 810 and sensor tubing 812*a*, 812*b* are joined together exclusively by welds (882*a*, 882*b*, 883*a* and 883*b*) to the exclusion of any screwed or other types of connections. By providing cylindrical symmetry of the sensor pod 810 about the sensor tubing 812*a*, 812*b* the welds 882*a*, 882*b*, 883*a* and 883*b*, as well as any circumferential welds which are used in fabricating the sensor pod 810, can be formed using an automated orbital welder. The use of an automated orbital welder allows heat applied during the welding process to be controlled so as to prevent damage to signal lines within the sensor tubing 812, and damage to components inside the sensor pod 810. As indicated, the sensor pod 810 can also be fabricated by welding sensor pod ends 810*a*, 810*b* to the main body (not numbered) of the sensor pod. Alternately, the sensor pod 810 can be fabricated from a single piece of metal (such as stainless steel) by processes such as turning on a lathe or extrusion. As described above, this fabrication process greatly reduces the likelihood of fluid intrusion into the signal tubing 812 and the sensor pod 810, and thus greatly reduces failure of the apparatus 100 (FIG. 1).

Figure 10:
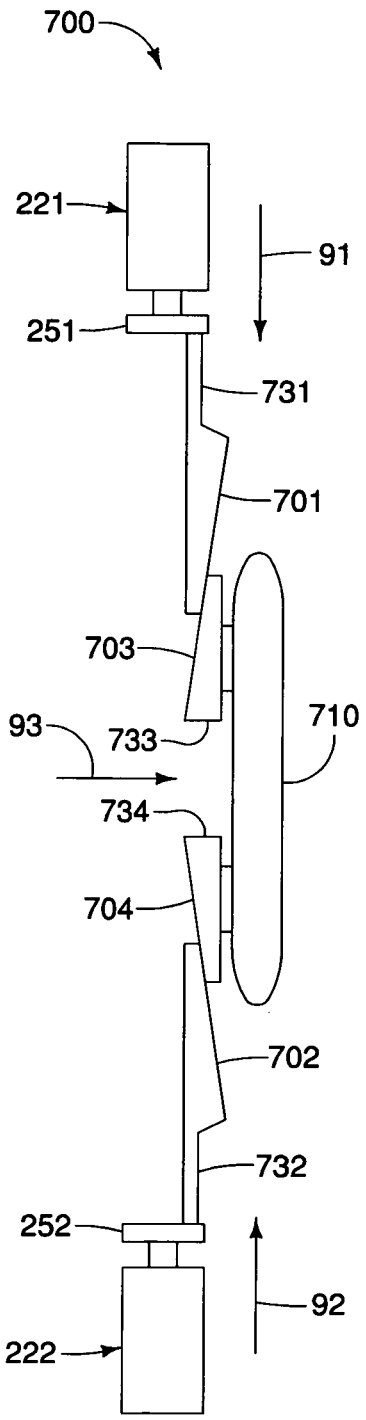
FIG. 10 is a side elevation view of an alternative embodiment of sensor pod housing assembly components according to the disclosure.

Turning now to FIG. 10, a side elevation view of at least a portion of a sensor pod housing assembly 700 is shown according to at least one further embodiment of the disclosure. The sensor pod housing assembly 700 is an alternative variation of the sensor pod housing assembly 200 shown in FIGS. 2-4. The sensor pod housing assembly 700 can be configured substantially similarly to, and can include substantially the same components as, the sensor pod housing assembly 200, except as specifically described with respect to FIG. 10. Accordingly, some common components of the pods 200 and 700 are not shown in FIG. 10. The sensor pod housing assembly 700 can include first and second actuators 221, 222, which are described herein with respect to FIGS. 2-4. With reference to FIG. 10, the sensor pod housing assembly 700 includes a deployable element 710. The deployable element 710 can be substantially similar to the deployable element 210 described above with respect to FIGS. 2-4. The sensor pod housing assembly 700 also includes the first actuator 221 and the second actuator 222, which are described above with reference to FIGS. 2-4.

With continuing reference to FIG. 10, the sensor pod housing assembly 700 includes a first engagement member 731, a second engagement member 732, a third engagement member 733, and a fourth engagement member 734. The first engagement member 731 is supported by the first actuator 221, while the second engagement member 732 is supported by the second actuator 222. According to the exemplary embodiment of the disclosure, the first and second engagement member 731, 732 are substantially rigidly affixed to the first movable member 251 and the second movable member 252, respectively. The third engagement member 733 and the fourth engagement member 734 can be attached to the deployable element 710, as is depicted in FIG. 10. According to one or more embodiments of the disclosure, the third and fourth engagement members 733, 734 are substantially rigidly affixed to the deployable element 710. The third engagement member 733 is adapted for sliding engagement with the first engagement member 731, and the fourth engagement member 734 is adapted for sliding engagement with the second engagement member 732. Conversely, the first engagement member 731 is adapted for sliding engagement with the third engagement member 733, and the second engagement member 732 is adapted for sliding engagement with the fourth engagement member 734.

As is seen from a study of FIG. 10, the first engagement member 731 can have a first ramped surface 701 defined thereon. The second engagement member 732 can have a second ramped surface 702 defined thereon. Similarly, the third engagement member 733 and the fourth engagement member 734 can have a third ramped surface 703 and a fourth ramped surface 704 defined thereon, respectively. According to the exemplary embodiment of the disclosure, each of the first, second, third and fourth engagement members 731, 732, 733, 734 has a respective ramped surface 701, 702, 703, 704 defined thereon as shown in FIG. 9. The first engagement member 731 can be adapted for sliding engagement with the third ramped surface 703. Similarly, the second engagement member 732 can be adapted for sliding engagement with the fourth ramped surface 704. The third engagement member 733 can be adapted for sliding engagement with the first ramped surface 701. Likewise, the fourth engagement member 734 can be adapted for sliding engagement with the second ramped surface 704. According to the exemplary embodiment of the disclosure, the first ramped surface 701 and the third ramped surface 703 are adapted for sliding engagement, while the second ramped surface 702 and the fourth ramped surface 704 are adapted for sliding engagement as is depicted in FIG. 10.

One or more of the ramped surfaces 701, 702, 703, 704 are oblique relative to at least one of the first direction 91, the second direction 92, and the third direction 93, which directions have been described herein with respect to FIGS. 2 4. One or more of the ramped surfaces 701, 702, 703, 704 can be substantially flat so as to substantially define a respective inclined plane relative to one or more of the first, second and third directions 91, 92, 93. According to the exemplary embodiment of the disclosure, all of the ramped surfaces 701, 702, 703, 704 are substantially flat and are oblique relative to one or more of the first, second, and third directions 91, 92, 93. However, in one variation the ramped surfaces 701 and 703 (and likewise, ramped surfaces 702 and 704) can be complimentary contoured for mating configuration. For example, ramped surface 701 can define a convex contoured surface, and ramped surface 703 can define a complimentary and mating concave surface. Alternately, ramped surface 701 can define a peaked contoured surface, and ramped surface 703 can define a complimentary and mating valleyed or grooved surface. Further, and as discussed below with respect to FIG. 11, the ramped and mating surfaces (e.g., surfaces 701 and 703) can be keyed to one another. By providing complimentary contours (and/or keys) between surfaces 701 and 703 (and/or 702 and 704), the ramped mating surfaces (701 and 703, and/or 702 and 704) can be held in relatively stable position with one another as the mating surfaces slide along one another during actuation of actuators 221 and 222. In another variation, the ramped surfaces 701, 702, 703, 704 are not substantially flat, but rather are curvilinear. The curvilinear shape of the mating ramped surfaces (e.g., surfaces 701 and 703) are selected to provide initial rapid movement of the deployable element 710 towards the borehole wall 11 during initial movement of the first and second movable members 251, 252 towards one another (i.e., in directions 91 and 92), and thereafter to provide a slower movement of the deployable element 710 towards the borehole wall 11 during continued progress of movable members 251, 252 towards one another. When the force applied by the movable members 251, 252 to the ramped surfaces 701, 702 over the entire movement of the movable members 251, 252 is constant, a greater leverage factor will be obtained when the curvilinear ramped surfaces provide the slower movement of the deployable element 710 towards the borehole wall 11. In this way a greater clamping force between the deployable element 710 and the borehole wall 11 can be obtained versus using ramped surfaces that are substantially flat. This arrangement (i.e., of using curvilinear ramped surfaces 701, 702, 703, 704) is particularly useful when the apparatus is deployed in a borehole having a known essentially constant diameter (e.g., as in the situation when the borehole is a cased borehole).

Figure 11:
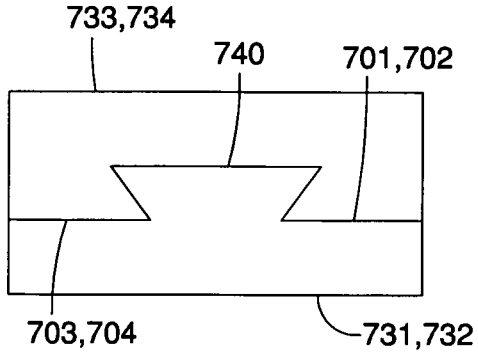
FIG. 11 is an end view of engagement members of the arrangement depicted in FIG. 10.

Turning now to FIG. 11, an end view of the engagement members 731, 732, 733, 734 is shown depicting an alternative arrangement for keying the surfaces 701 and 703, and/or 702 and 704, to one another. Referring to FIGS. 10 and 11, the sensor pod housing assembly 700 can include a retaining feature 740 according to at least one embodiment of the disclosure. The retaining feature 740 can be defined in the first and the third engagement members 731, 733 to retain the first and the third engagement members in substantial operative sliding engagement with one another. Likewise, the retaining feature 740 can be defined in the second and the fourth engagement members 732, 734 to retain the second and the fourth engagement members in substantial operative sliding engagement with one another. As is depicted in FIG. 11, the retaining feature 740 can be substantially in the form of a longitudinally slidable tongue-and-groove connection. However, it is to be understood that one or more of a number of alternative configurations of the retaining feature 740 can be employed according to the scope of the present disclosure, the general purpose being to slidingly capture the first and the third engagement members 731, 733 to one another, and to slidingly capture the third and the fourth engagement members 733, 734 to one another.

Turning back to FIG. 10, it is seen that the first movable portion 251 and the second movable portion 252 will extend substantially in the first and second directions 91, 92, respectively, as a result of operation of the first and second actuators 221, 222. Such movement of the first and second movable portions 251, 252 can, in turn, result in movement of the first and second engagement members 731, 732 in the first and second directions 91, 92, respectively. More specifically, such movement of the first and second engagement members 731, 732 causes the first and second engagement members to move substantially toward each other. Movement of the first and second engagement members 731, 732 in the first and second directions 91, 92, respectively, or substantially toward each other, can result in impingement of the first engagement member 731 against the third engagement member 732, and impingement of the second engagement member 732 against the fourth engagement member 734. From a study of FIG. 10, it is seen that such movement of the first and second engagement members 731, 732 while impinging upon the third and fourth engagement members, respectively, can cause movement of the deployable element 710 (FIG. 10) substantially in the third direction 93.

Retraction of the element 710 (FIG. 10) from the borehole wall (e.g., 11, FIG. 2) can be effected by moving the first and second engagement members 731, 732 in directions opposite to the first and second directions 91, 92 (and particularly, when first and second engagement members 731, 732 are coupled to the respective third and fourth engagement members 733, 734 as indicated by FIG. 10).

As an alternative to, or in addition to, providing natural spring-biased means for retracting the deployable element (e.g., deployable element 210, 310, 610) from contact with the borehole wall (11, FIG. 1), a negative hydraulic pressure (with respect to the pressure within the borehole 10) can be generated within the tubing 130 via pump 121 (FIG. 1). That is, by causing pump 121 to extract fluid from the tubing 130, the actuators 221, 222 will cause respective first and second actuator moveable portions 251, 252 (e.g., FIG. 3) to move in directions opposite to respective directions 91, 92 (again, FIG. 3), to thus retract the deployable element (e.g., 210, FIG. 3) from contact with the borehole wall. Accordingly, the apparatus 100 disclosed herein further includes means for extracting fluid from tubing 130 in order to create a negative hydraulic pressure (i.e., relative to the pressure within borehole 10) within tubing 130 in order to cause first and second actuator moveable portions 251, 252 to move in directions opposite to respective directions 91, 92 (as such directions are depicted in FIG. 3, at least).

As can be appreciated, in a receiver array consisting of a number "N" of receiver elements 210 (e.g., FIG. 1) deployed along a substantial vertical length "L" (FIG. 1) within a borehole 10, the hydrostatic head of fluid within the tubing 130 (FIG. 1) or 860 (FIG. 9A) and its constituent components (132, 133) can result in a substantial hydraulic force being applied to the actuators 221 and 222 in the lowermost sensor pod housing assemblies (200, FIG. 1). That is, the force applied by a hydrostatic head of fluid within the tubing 130 may be insufficient to deploy the receiver elements 210 proximate the upper end of the receiver array 100, but may be sufficient, absent any additional pressure applied to hydraulic fluid in the tubing 130, to deploy the receiver elements 210 proximate the lower end of the receiver array. In order to address this predicament, the bow-string members 231 and 232 can be provided with increasingly higher spring constants along the array of receiver elements 1 through N. More specifically, a spring constant for any given bow-string member (231 and/or 232) can be determined as follows. First, determine the ultimate depth to which any final receiver deployable element 210 within the array (i.e., receiver deployable element 210-N, from among receiver elements 210-1 through 210 N) may be deployed. Second, select a spring constant for the bow-springs 231, 232 to be used for receiver deployable element 210-N such that the hydrostatic head applied to the actuators 221 and 222 will not deploy the final receiver deployable element 210-N. Third, select spring constants for the remaining bow-springs 231, 232 to be used for the remaining receiver elements 210-1 through 210 (N−1) based on the difference between the spring constant required for deployable element 210-N and that required for 210-1 (i.e., the highest level receiver element). Put more generally, the spring constant for bow springs 231, 232 can be increased as a function of the anticipated depth to which the associated receiver deployable element 210 is to be deployed. The same philosophy applies to return springs 266 as applied to the arrangement depicted in FIG. 9A, and as can also be applied to the configuration depicted in FIG. 10.

In yet a further variation, in order to address the situation of variance of hydrostatic head within the tubing 130 (FIG. 1) and its constituent components (132, 133) within the overall receiver array apparatus 100, a master control valve can be placed in-line in the tubing 130 prior to (or immediately following) the first sensor pod housing assembly 200 in the receiver array apparatus 100. Secondary slave control valves can then be placed periodically along the length "L" of the receiver array apparatus 100. The secondary slave control valves can receive a signal from the master control valve to only allow such additional fluid flow through the secondary slave control valves as is necessary to essentially balance the pressure in the line (tubing) 130 after each secondary slave control valve to be essentially the same as the pressure in the line 130 proximate the first sensor pod housing assembly 200 in the receiver array apparatus 100.

An additional variation to address the situation of variance of hydrostatic head within the tubing 130 (FIG. 1) and its constituent components (132, 133) within the overall receiver array apparatus 100 is to flood the wellbore 10 (FIG. 1) with hydraulic fluid. In this way the fluid pressure exerted on the outside of the sensor pod (e.g., sensor pod 810 of FIG. 9) will be balanced with the hydraulic pressure in the tubing 130 absent any additional pressure being applied on the hydraulic fluid in the tubing 130 (as, for example, by way of pump 121 of FIG. 1). In this example the pressure of the hydraulic fluid in the wellbore 10 acting on the external surfaces of the sensor pod (e.g., sensor pod 810 of FIG. 9) and the moveable portions of the deployment apparatus (e.g., 850, FIG. 9) is balanced with the hydraulic pressure inside of tubing 130 (FIG. 1) and associated hydraulic tubing (e.g., 860, FIG. 9A). Thus, it only takes incremental pressure exerted by pump 121 (FIG. 1) on the internal hydraulic tubing (130 of FIGS. 1, and 860 of FIG. 9A) in order to overcome the resistive pressure exerted by the return elements (e.g., springs 231 and 232 of FIG. 2, and return springs 866 of FIGS. 9A and 9B) in order to deploy the sensor pod (e.g., sensor pod 810, FIG. 9) against the borehole wall (e.g., wall 11, FIG. 1). This arrangement to allow balanced hydraulic fluid pressure to be equally applied to components exterior to the sensor pod (e.g., 810, FIG. 9) and interior to the hydraulic tubing (e.g., 860, FIG. 9B) used for activating deployment of a sensor pod (via hydraulic pressure applied by pump 121) ensures that sensor pods will not be deployed as a mere result of hydrostatic pressure alone.

Figure 12:
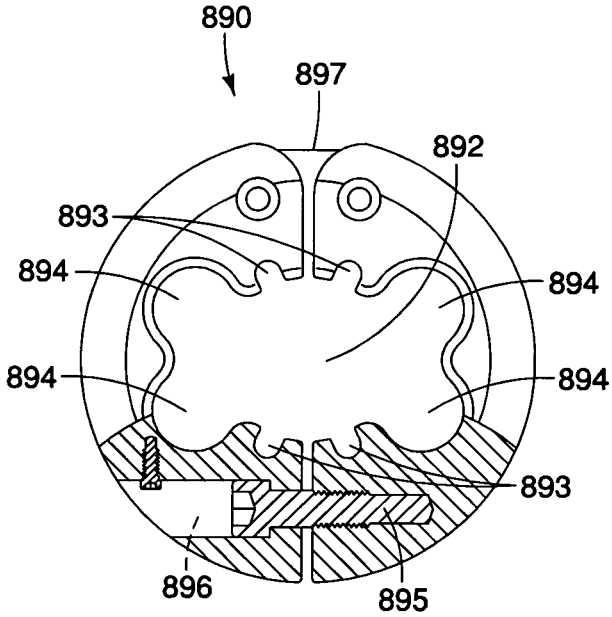
FIG. 12 is an end view of a centralizing tube wave attenuator that can be used on piping connecting sensor pod housing assemblies.

FIG. 12 is an end view of a centralizer 890 that can be applied to the tubing 130 (FIG. 1). The centralizer is a two part assembly having first and second centralizer halves 890*a* and 890*b*, which can be joined to one another such as by one or more fasteners 895 placed in a fastener opening 896. The centralizer halves 890*a* and 890*b* can be hinged to one another at a side opposite the fastener 895 by hinge 897. The centralizer halves 890*a* and 890*b*, when joined together, define a hydraulic tubing opening 892 so that the centralizer 890 fits around tubing 130, The centralizer 890 also defines one or more signal tubing openings 893 so that the centralizer fits around the signal tubing (812, FIG. 9A). As depicted in FIG.

12, the centralizer 890 can include a plurality of signal tube openings 893 which are in communication with the hydraulic tubing opening 892. The advantage of placing the signal tube openings 893 in communication with the hydraulic tubing opening 892 is so that the centralizer 890 can thus securely anchor the signal tubing (812, FIG. 9A) to the tubing 130 (FIG. 1). This arrangement facilitates reduction of standing waves and other vibrations being imparted to the various components of the apparatus 100. Further, the provision of a plurality of signal tube openings 893 in communication with the hydraulic tubing opening 892 allows for ease of orientation of the centralizer 890 when placed about the tubing 130, and also allows a plurality of signal tubes (812) to be accommodated by the centralizer. Each of the centralizer halves 890*a* and 890*b* also include fluid openings 894 which allow the apparatus 100 (FIG. 1) to be placed in a fluid-filled wellbore 10 and pass down through the fluid. In use the centralizer 890 is preferably placed proximate a midpoint along the length of pipe or tubing segments 131, 132 (FIG. 1), and the centralizer is securely attached to the pipe. The centralizer 890 also acts as a tube wave attenuator to reduce vibration-induced tube waves which can form in the tubing sections (131, 132). Since these tube waves are often of a frequency which is at or near the frequency of seismic waves, reducing tube waves in the tubing (130) can significantly improve the signal to noise ratio of seismic signals detected by the sensors in the sensor pods (e.g., sensor pod 810, FIG. 9).

With reference to all of the drawing figures, a method according to one or more embodiments of the disclosure includes placing a sensor pod housing assembly 200, 300, 400, 500, 600, 700, 800 in a borehole 10. The method can include employing the sensor pod housing assembly 200, 300, 400, 500, 600, 700, 800 to detect and/or gather seismic and/or acoustic signals and/or data while in the borehole. The method can include deploying the deployable element 210, 310, 610, 710, 810 while the sensor pod housing assembly is in the borehole 10.

The preceding description has been presented only to illustrate and describe exemplary methods and apparatus of the present invention. It is not intended to be exhaustive or to limit the disclosure to any precise form disclosed. Many modifications and variations are possible in light of the above teaching. It is intended that the scope of the invention be defined by the following claims.

I claim:

1. A sensor pod housing assembly for placement within a borehole, comprising:

a housing;

a selectively operable first hydraulic actuator supported by the housing and adapted to act in a first direction;

a selectively operable second hydraulic actuator supported by the housing and adapted to act in a second direction which is parallel to and opposite the first direction;

a sensor pod adapted to contact a wall of the borehole when deployed to immobilize the sensor pod relative to the borehole;

a first rigid link pivotally connected between the first hydraulic actuator and the sensor pod; and a second rigid link pivotally connected between the second hydraulic actuator and the sensor pod.

2. The sensor pod housing assembly of claim 1 and wherein each hydraulic actuator includes a moveable portion which acts against the associated rigid link when the hydraulic actuators are actuated.

3. The sensor pod housing assembly of claim 2 and further comprising:

a first return spring that acts to move the moveable portion of the first hydraulic actuator into the first hydraulic actuator when the first hydraulic actuator is not being actuated; and a second return spring that acts to move the moveable portion of the second hydraulic actuator into the second hydraulic actuator when the second hydraulic actuator is not being actuated.

4. The sensor pod housing assembly of claim 3 and wherein each hydraulic actuator includes a hydraulic fluid port allowing hydraulic fluid to be ported between the hydraulic actuators, the sensor pod housing assembly further comprising hydraulic tubing connected to the fluid port of each hydraulic actuator to place the hydraulic actuators in fluid communication with one another.

5. The sensor pod housing assembly of claim 4 and wherein each hydraulic actuator includes a piston which moves outward from each hydraulic actuator when the hydraulic actuators are actuated, the sensor pod housing assembly further comprising:

a first carriage disposed between the first hydraulic actuator piston and the first rigid link;

a second carriage disposed between the second hydraulic actuator piston and the second rigid link;

and wherein each carriage is moveably supported by the hydraulic tubing.

6. The sensor pod housing assembly of claim 5 and wherein each carriage comprises:

a ball bearing placed within a recess defined within each carriage;

a bearing spring which biases each ball bearing outward of the recess in each carriage; and a ball bearing retainer to prevent each ball bearing from exiting the recess in each carriage;

and wherein each ball bearing rides along an inner surface of the housing as the respective carriage moves in response to the respective hydraulic actuators being actuated.

7. The sensor pod housing assembly of claim 5 and wherein the hydraulic tubing is a first hydraulic tubing, the sensor pod housing assembly further comprising a second hydraulic tubing which also places the hydraulic actuators in fluid communication with one another, and which is spaced apart from and parallel to the first hydraulic tubing; and further wherein each carriage is moveably supported by the first hydraulic tubing and the second hydraulic tubing.

8. The sensor pod housing assembly of claim 7 and further comprising:

a first pusher bar disposed between the first hydraulic actuator piston and the first carriage;

a second pusher bar disposed between the second hydraulic actuator piston and the second carriage;

and wherein the pusher bars are disposed between the first hydraulic tubing and the second hydraulic tubing.

9. The sensor pod housing assembly of claim 8 and further comprising:

a first return spring that acts to move the piston of the first hydraulic actuator into the first hydraulic actuator when the first hydraulic actuator is not being actuated; and a second return spring that acts to move the piston of the second hydraulic actuator into the second hydraulic actuator when the second hydraulic actuator is not being actuated.

10. The sensor pod housing assembly of claim 9 and further comprising a sensor pod support platform, and wherein:

each rigid link is connected to the respective carriage by a first pivot joint located proximate a first end of each rigid link;

each rigid link is connected to the sensor pod support platform by a second pivot joint located proximate a second end of each rigid link;

the second pivot joints are located proximate opposite ends of the sensor pod support platform; and the sensor pod is secured to the sensor pod support platform.

11. The sensor pod housing assembly of claim 10 and wherein each rigid link is connected to the respective carriage at the first pivot joint and an angle which is obtuse to the respective pusher bars.

12. The sensor pod housing assembly of claim 11 and wherein the housing defines a housing opening which allows the sensor pod to be deployed outward of the housing when the hydraulic actuators are actuated.

13. The sensor pod housing assembly of claim 12 and wherein the housing is defined by opposing first and second housing ends, the sensor pod housing assembly further comprising:

a first housing end piece secured within the first end of the housing;

a second housing end piece secured within the second end of the housing; and wherein:

the first housing end piece includes a female threaded end piece fluid line connector portion;

the second housing end piece includes a male threaded end piece fluid line connector portion; and each housing end piece defines an access passageway which receives signal line tubing connected to the sensor pod.

14. The sensor pod housing assembly of claim 13 and wherein each housing end piece comprises a gate which can be selectively opened and closed to allow the signal line tubing to be respectively placed within and held within the respective access passageway.

15. A sensor pod housing assembly, comprising:

a housing comprising a hollow tube and defining a housing opening defined along a length of the housing and further defining a hollow portion defined within the housing and accessible via the housing opening;

a first housing end piece attached to the housing proximate a first end of the housing;

a second housing end piece attached to the housing proximate a second end of the housing;

a first actuator/manifold secured to the first housing end piece and disposed within the hollow portion of the housing;

a second actuator/manifold secured to the second housing end piece and disposed within the hollow portion of the housing in generally opposed orientation to the first actuator/manifold;

a first actuator moveable portion;

a second actuator moveable portion;

a first link and a second link;

a sensor pod; and a sensor pod support platform defined by opposing sensor pod support platform ends;

and wherein:

each actuator moveable portion comprises:

a piston moveably received within the actuator/manifold;

a piston return bracket connected to the piston;

a pusher bar connected to the piston return bracket at a first end of the pusher bar; and a carriage connected to the pusher bar at a second end of the pusher bar;

each carriage is connected to a first end of one of the links by a first pivot joint;

each link is connected at a second end of each link to one of the opposing ends of the a sensor pod support platform;

the sensor pod is secured to the sensor pod support platform;

each link is oriented at an obtuse angle to the respective pusher bar connected to the respective link by the respective carriage;

each actuator/manifold defines a first and a second fluid port for hydraulic fluid, the fluid ports being spaced-apart from one another;

the first fluid port of each actuator/manifold is connected to the first fluid port of the other actuator/manifold by a first hydraulic tubing;

the second fluid port of each actuator/manifold is connected to the second fluid port of the other actuator/manifold by a second hydraulic tubing;

the first and second hydraulic tubing are placed in parallel orientation with respect to one another;

the pusher bars are disposed between the parallel first and second hydraulic tubing; and the sensor pod housing assembly further comprises:

for each actuator/manifold, two spring supports attached thereto, the spring supports comprising parallel rods passing through spring support openings defined in each piston return bracket; and for each actuator/manifold, two return springs, each return spring comprising a coil spring placed along the respective spring support and held in place on the respective spring support by an end cap placed on each spring support, each return spring being defined by an outside diameter which is greater than a diameter of the spring support openings defined in each piston return bracket such that the return springs exert a return force on the respective piston return brackets and thus on the pistons attached to the respective piston return brackets.

16. The sensor pod housing assembly of claim 15 and further comprising a first sensor signal line tubing attached to a first end of the sensor pod, and a second sensor signal line tubing attached to a first end of the sensor pod.

17. An apparatus comprising a plurality of sensor pod housing assemblies according to claim 15, and wherein the plurality of sensor pod housing assemblies are connected to one another in series by one or more pipes.

18. The apparatus of claim 17 and further comprising a tube wave attenuator secured to each pipe proximate a midpoint of each pipe, the tube wave attenuator comprising a two piece assembly configured to clamp about each pipe and signal line tubing connecting the sensor pods in the plurality of sensor pod housing assemblies.

19. The apparatus of claim 18 and wherein the one or more pipes are fabricated from S135 steel alloy.

* * * * *